US006783906B2

(12) United States Patent
Ishida et al.

(10) Patent No.: US 6,783,906 B2
(45) Date of Patent: Aug. 31, 2004

(54) IMAGE FORMING APPARATUS

(75) Inventors: Toshihisa Ishida, Nara (JP); Masanori Matsumoto, Nara (JP); Tadayuki Sawai, Nara (JP); Kouji Kida, Nara (JP); Yuko Takeda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 18 days.

(21) Appl. No.: 10/336,837

(22) Filed: Jan. 6, 2003

(65) Prior Publication Data

US 2003/0215266 A1 Nov. 20, 2003

(30) Foreign Application Priority Data

Jan. 8, 2002 (JP) ..... 2002-001454

(51) Int. Cl.[7] ..... G03G 9/10

(52) U.S. Cl. ..... 430/107.1; 430/111.4; 399/159

(58) Field of Search ..... 430/107.1, 111.4; 399/159

(56) References Cited

FOREIGN PATENT DOCUMENTS

| | | | |
|---|---|---|---|
| JP | 5-53414 | A | 3/1993 |
| JP | 8-106197 | A | 4/1996 |
| JP | 9-319179 | A | 12/1997 |
| JP | 10-333393 | A | 12/1998 |
| JP | 11-24358 | A | 1/1999 |
| JP | 11-52599 | A | 2/1999 |
| JP | 11-249452 | A | 9/1999 |
| JP | 2000-242056 | A | 9/2000 |
| JP | 2000-242057 | A | 9/2000 |
| JP | 2000-330303 | A | 11/2000 |
| JP | 2001-51467 | A | 2/2001 |

*Primary Examiner*—Mark A. Chapman
(74) *Attorney, Agent, or Firm*—Nixon & Vanderhye, P.C.

(57) ABSTRACT

An image forming apparatus having a tandem system configuration, includes: a multiple number of photoreceptors which each form an electrostatic latent image; and a multiple number of developing devices each holding a different color toner from the others for development of the corresponding static latent image, and is constructed so that the plural toners at least include a black toner, and the abrading force of the black toner or its carrier therein acting on the photoreceptor surface is adjusted so as to be smaller than that of the other developing toners or their carrier therein. Since, in a tandem type color image forming apparatus, the developing devices, photoreceptors and toners for all colors will reach the end of their life at the same time, the image forming apparatus can be operated at low cost.

39 Claims, 2 Drawing Sheets

IMAGE FORMING APPARATUS

BACKGROUND OF THE INVENTION (1) Field of the Invention

The present invention relates to a color image forming apparatus such as a color printer, etc., and more detailedly, relates to a tandem type color image forming apparatus wherein a multiple number of photoreceptors are charged so as to develop color images by developing devices holding different color toners.

(2) Description of the Prior Art

Recently, in the field of color electrophotographic processing, tandem type color image forming apparatuses in which a multiple number of photoreceptor drums are arranged in line to obtain a color image of multiple colors of toner have been used in order to enhance the printing speed. This tandem type color image processing lends itself to color image forming apparatuses and multi-color image forming apparatuses for outputting image formed articles of reproduction and composition of color images and multi-color images by successively transferring a plurality of color separation images for color image data or multi-color image data, in a layered manner, as well as machines having these functions.

FIG. 1 is a front sectional view showing the overall configuration of a digital color copier 1 as a typical example of the tandem type. Copier body 1 has an original table 111 and an aftermentioned control panel on the top thereof and has an image reading portion 110 and an image forming unit 210 within. A reversing automatic document feeder (RADF) 112 is arranged on the top surface of original table 111 in a predetermined position with resect to the original table 111 surface whilst being supported so as to be opened and closed relative to original table 111.

RADF 112, first, conveys an original so that one side of the original opposes image reading portion 110 at the predetermined position on original table 111. After the image scanning of this side is completed, the original is inverted and conveyed to original table 111 so that the other side opposes image reading portion 110 at the predetermined position on original table 111. Then, when RADF 112 completes image scanning of both sides of one original, the original is discharged and the duplex copy conveying operation for a next document is implemented. The operation of the conveyance and face inversion of the original is controlled in association with the whole copier operation.

Image reading portion 110 is disposed below original table 111 in order to read the image of the original conveyed onto original table 111 by means of RADF 112. Image reading portion 110 includes original scanning portion 113 and 114 which reciprocates along, and in parallel to, the undersurface of original table 111, an optical lens 115 and a CCD line sensor 116 as a photoelectric converting device.

This original scanning portion 113 and 114 is composed of first and second scanner units 113 and 114. First scanner unit 113 has an exposure lamp for illuminating the original image surface and a first mirror for deflecting the reflection image of light from the original toward the predetermined direction and moves at the predetermined speed in a reciprocating manner in parallel with, whilst being kept a certain distance away from, the undersurface of original table 111. Second scanner unit 114 has second and third mirrors which deflect the reflected light image from the original, deflected by first mirror of first scanner unit 113 toward the predetermined direction and moves in a reciprocating manner at a speed related to that of first scanner unit 113 and in parallel thereto.

Optical lens 115 reduces the reflected light image from the original, thus deflected by third mirror of the second scanner unit, so that the reduced light image will be focused on the predetermined position on CCD line sensor 116.

CCD line sensor 116 implements sequential photoelectric conversion of the focused light image into electric signals and outputs them. CCD line sensor 116 is a three-line color CCD which reads monochrome or color images and outputs line data as to color separation components R (red), G (green) and B (blue). The original image information thus obtained in the electric signal form from this CCD line sensor 116 is further transferred to the image processor where predetermined image data processes are performed.

Next, the configuration of image forming unit 210 and the configuration of the components related to image forming unit 210 will be described.

Provided below image forming unit 210 is a paper feeding mechanism 211 which separates a sheet of paper (recording medium) P, one by one, from a stack of paper held in a paper tray and feeds it toward image forming unit 210. The paper P thus separated is delivered into image forming unit 210 with its timing controlled by a pair of registration rollers 212 located before image forming unit 210. The paper P with an image formed on its one side is conveyed and re-fed to image forming unit 210 in time with image forming of image forming unit 210.

Arranged under image forming unit 210 is a conveyer and transfer belt mechanism 213. A conveyer and transfer belt 216 of conveyer and transfer belt mechanism 213 is wound and tensioned between a driving roller 214 and an idle roller 215 so that the upper and lower parts of the belt extend approximately parallel to each other. The conveyer and transfer belt 216 electrostatically attracts paper P to itself to convey it. Further, a pattern image density measuring unit is provided under and in proximity to conveyer and transfer belt 216.

Arranged in the paper conveyance path, downstream of conveyer and transfer belt mechanism 213 is a fixing unit 217. This fixing unit 217 fixes the transferred toner image onto paper P.

The paper P having passed through the nip between a pair of fixing rollers of fixing unit 217 passes through a conveyance direction switching gate 218 and is discharged by discharge rollers 219 to a paper output tray 220 attached to the outer wall of copier body 1.

This switching gate 218 selectively connects the conveyance path of paper P after fixing with either the path to discharge paper P to the outside of copier body 1 or the path to recirculate paper P toward image forming unit 210. The paper P which is designated to be conveyed again to image forming unit 210 by means of switching gate 218 is inverted by means of a switch-back conveyance path 221 and then re-fed to image forming unit 210.

Arranged above, and in proximity to, conveyer and transfer belt 216 in image forming unit 210 are the first image forming station Pa, the second image forming station Pb, the third image forming station Pc and the fourth image forming station Pd, in the above mentioned order from the upstream side of the paper conveyance path.

Conveyer and transfer belt 216 is frictionally driven by driving roller 214 in the direction indicated by arrow Z in FIG. 1, and carries paper P which is fed by paper feeding mechanism 211 as stated above and sequentially conveys it through image forming stations Pa to Pd.

All the image forming stations Pa to Pd are of a substantially identical configuration. Each image forming station Pa, Pb, Pc and Pd has a photoreceptor drum 222*a*, 222*b*, 222*c* and 222*d*, which is driven in the rotational direction indicated by arrow F in FIG. 1.

Provided around each photoreceptor drum 222*a*–222*d*, are a primary charger 223*a*, 223*b*, 223*c* and 223*d* for uniformly charging photoreceptor drum 222*a*–222*d*, a developing unit 224*a*, 224*b*, 224*c* and 224*d* for developing the static latent image formed on photoreceptor drum 222*a*–222*d*, a transfer charger 225*a*, 225*b*, 225*c* and 225*d* for transferring the developed toner image on photoreceptor drum 222*a*–222*d* to paper P, cleaning unit 226*a*, 226*b*, 226*c* and 226*d* for removing the leftover toner from photoreceptor drum 222*a*–222*d*, in this order with respect to the rotational direction of each photoreceptor drum 222*a*–222*d*.

Arranged above photoreceptor drums 222*a*–222*d* are laser beam scanner units 227*a*, 227*b*, 227*c* and 227*d*, respectively. Each laser beam scanner unit 227*a*–227*d* includes: a semiconductor laser element (not shown) for emitting a spot beam modulated in accordance with the image data; a polygon mirror (deflecting device) 240 for deflecting the laser beam from the semiconductor laser element, in the main scan direction; an f-theta lens 241 for focusing the laser beam deflected by polygon mirror 240 onto the surface of photoreceptor drum 222*a*–222*d*; and mirrors 242 and 243.

The pixel signal corresponding to the black component image of a color original image is supplied to laser beam scanner unit 227*a*; the pixel signal corresponding to the cyan color component image of a color original image is supplied to laser beam scanner unit 227*b*; the pixel signal corresponding to the magenta color component image of a color original image is supplied to laser beam scanner unit 227*c*; and the pixel signal corresponding to the yellow color component image of a color original image is supplied to laser beam scanner unit 227*d*.

In this arrangement, the static latent images corresponding to the color separations of the original image information are formed on photoreceptor drums 222*a* to 222*d*. Developing units 224*a*, 224*b*, 224*c* and 224*d* hold black toner, cyan color toner, magenta color toner and yellow color toner, respectively. The static latent image on photoreceptor drum 222*a*–222*d* is developed by the toner of a corresponding color. Thus, the color separations of the original image information are reproduced in image forming unit 210 as toner images of different colors.

Provided between the first image forming station Pa and paper feeding mechanism 211 is a paper-attraction charger 228, which electrifies the conveyer and transfer belt 216 surface so that paper P fed from paper feeding mechanism 211 can be conveyed without any slip or slide, whilst being reliably attracted to conveyer and transfer belt 216, from the first image forming station Pa to the fourth image forming station Pd.

An erasing device 229 is arranged approximately right above driving roller 214 located between the fourth image forming station Pd and fixing unit 217. Applied to this erasing device 229 is an alternating current for separating paper P electrostatically attracted to conveyer and transfer belt 216, from the belt.

In the thus configured digital color copier, cut-sheet type paper is used as paper P. When paper P is delivered from the paper feed cassette into the guide along the paper conveyance path of paper feeding mechanism 211, the leading edge of paper P is detected by a sensor (not shown), which outputs a detection signal, and based on the detection signal the paper is briefly stopped by a pair of registration rollers 212.

Then, paper P is sent out in synchronization with image forming stations Pa to Pd, onto conveyer and transfer belt 216 that is rotating in the direction of arrow Z in FIG. 1. At this point, conveyer and transfer belt 216 has been charged in a predetermined manner by paper attraction charger 228 as stated above, so that paper P is stably fed and conveyed during its passage through all the image forming stations Pa to Pd.

In each image forming station Pa-Pd, the toner image of each color is formed so that the different color images are superimposed on the support surface of paper P which is conveyed whilst being electrostatically attracted by conveyer and transfer belt 216. When transfer of the image formed by the fourth image forming station Pd is completed, paper P is separated by virtue of the erasing charger, continuously starting at its leading edge, from conveyer and transfer belt 216 and introduced into fixing unit 217. Finally, paper P having the toner image fixed thereon is discharged through the paper discharge port (not shown) onto paper output tray 220.

In the above description, the photoreceptors are exposed to scanning laser beams from laser beam scanner units 227*a*–227*d*, so that optical images are written onto the photoreceptors. However, instead of the laser beam scanner units, another optical writing system (LED head) made up of a light emitting diode array with a focusing lens array may be used. In this case, an LED head is smaller in size compared to the laser beam scanner unit and has no moving parts hence is silent. Therefore, this LED head can be preferably used for an image forming apparatus, such as a tandem type digital color copier, which needs multiple optical writing units.

In actual usage circumstances, such a color image forming apparatus is not only used for color printing but is often used for printing of monochrome (black and white) images. A typical operational control made in accordance with user mode selection will be described with reference to the flowchart shown in FIG. 2. First, when color image output mode is selected (Y at Step S1), all the photoreceptors 222*a*, 222*b*, 222*c* and 222*d* are set at the ordinary positions where they come in contact with conveyer and transfer belt 216 (S2). Then all the photoreceptors 222*a*, 222*b*, 222*c* and 222*d* are driven to rotate to implement charging, development and other necessary operations for each of the photoreceptors 222*a*, 222*b*, 222*c* and 222*d*, in accordance with the electrophotographic process (S3), whereby a color image is formed on a sheet of paper.

On the other hand, when black/white image output mode is selected (N at S1), a separation/abutment mechanism is actuated so that photoreceptors 222*b*, 222*c* and 222*d* for yellow (Y), magenta (M) and cyan (C) are separated from conveyer and transfer belt 216 (S5). Then, drives of these photoreceptors 222*b*, 222*c* and 222*d* are turned off to stop them rotating (S6). At the same time, charging, development and other necessary operations for these photoreceptor 222*b*, 222*c* and 222*d* are turned off (S7). In this condition, photoreceptor 222*a* for black development is driven to rotate (S8) to implement charging, development and other necessary operations for the photoreceptor 222*a* for black development, in accordance with the electrophotographic process (S9) to thereby produce a monochrome image with black toner on a sheet of paper.

Conventionally, when the black/white image output mode is selected, photoreceptors 222*b*, 222*c* and 222*d*, other than photoreceptor 222*a* for black development, are set into a non-active state by stopping the rotation or some other way and caused to part with transfer and conveyance belt 216. Accordingly, no surface coatings of photoreceptors 222*b*, 222*c* and 222*d* unused in the black/white image output mode will be abraded by the cleaning blades and other components or by printing paper, transfer and conveyance belt 216, etc.

Usually, the image forming apparatus of this kind is used more often for monochrome printing than for color printing, hence there is a drawback that the photoreceptor for black images becomes worn away relatively faster than the photoreceptors for other colors. As a result, the four photoreceptors for the four colors of toners Y, M, C and black, differ in amount of abrasion, hence the ways of degradation of the photoreceptors differ between the toner colors. If the photoreceptors are abraded and degraded differently from one color to another, there will occur color imbalance in color image as the number of copies increases.

In this case, since the degradation rates of the drums differ between color types of developing devices, even if only one of them degrades, all the drums should be replaced. Otherwise, color imbalance between the new drum and the other drums which have not been replaced, occurs, resulting in failure to obtain good image quality. In other words, the interval of drum replacement is determined by the most intensively degraded drum among the four, i.e., the drum for black development. This results in being wasteful and uneconomical.

As countermeasures, Japanese Patent Application. Laid-open Hei 10 No.10-333393, Japanese Patent Application Laid-open Hei 11 No.24358 and Japanese Patent Application Laid-open Hei 11 No.52599, disclose configurations in which an α-Si or α-SiC photoreceptor is used for that for black development so as to enhance the photoreceptor life while OPCs(organic photoreceptors) are used for those other than that for black development.

There is, however, a problem that α-Si and α-SiC photoreceptors are less chargeable. As a solution to this drawback, Japanese Patent Application Laid-open Hei 10 No.10-333393 specifies the thickness of the photoconductive layer to be 30 μm or more and its difference in surface potential from the other organic photoreceptors to be equal to or lower than 200 V. Japanese Patent Application Laid-open Hei 11 No.24358 proposes that the applied voltage to the α-Si photoreceptor should be 1.05 to 2.50 times the application voltage to the organic photoreceptors. Further, Japanese Patent Application Laid-open Hei 11 No.52599 is aimed at increasing the chargeability by adding an α-SiC surface layer.

In the above way, in order to extend the life of the photoreceptor for black development while making up for the low chargeability of the α-Si or α-SiC photoreceptor, it is necessary to make complicated charge control for black development, resulting in the need of extra cost. Further, since, other than the charge control, there are differences in light sensitivity and susceptivity to temperature/humidity, between the α-Si or α-SiC photoreceptor and the organic photoreceptor, light exposure, transfer conditions and other factors differ between the α-Si or α-SiC photoreceptor for black development and the organic photoreceptors for development other than black. Therefore, a different control method of the photoreceptor for black development from that for the photoreceptors for the other colors should be used, thus again resulting in the need of extra cost.

The α-Si or α-SiC photoreceptors disclosed in Japanese Patent Application Laid-open Hei 10 No.10-333393, Japanese Patent Application Laid-open Hei 11 No.24358 and Japanese Patent Application Laid-open Hei 11 No.52599, have the problem that their production cost is obviously high compared to the organic photoreceptors. Further, as another problem, they consume large amounts of black toner, as is well known.

As the countermeasures against the above problems, Japanese Patent Application Laid-open 2000 Nos. 242056 and 242057 propose configurations where the drum for black development alone is increased in diameter or increased in film thickness. Japanese Patent Application Laid-open 2001 No.51467 refers to use of a non-contact type charging means only for black development, increase in film thickness and use of a resin having a large viscosity-average molecular weight. Further Japanese Patent Application Laid-open 2000 No.330303 discloses a polycarbonate copolymer resin as the resin for tandem photoreceptors.

Further, provision of a protective layer on only the photoreceptor for black development has been also investigated as an optional method.

Use of a different photoreceptor only for black development in the above ways increases the management tasks. Further, use of a resin having a large viscosity-average molecular weight makes it difficult to apply it.

The solution of increasing the coating film thickness entails the problems that the amount of electrification of the photoreceptor decreases and that the resolution decreases, and other problems. Enlargement of the drum diameter makes the apparatus bulky. Almost all the photoreceptors used at present have no protective coating. This implies that an effective protective coating has not yet been developed.

Moreover, drum wear is attributed to abrasion with printing paper, cleaning blade, charger, developing portion and others, and among these the main cause is considered to be abrasion with the cleaning blade. Therefore, if a non-contact type charging means were used for the charging means for black development only, this will not be a principal, or valid solution, to the drum wear though it is better than nothing.

On the other hand, Japanese Patent Application Laid-open Hei 5 No.53414 and Japanese Patent Application Laid-open Hei 11 No.249452 refer to tandem type image forming apparatuses involving a cleanerless system. These publications, however, are aimed solely at making the machines compact and have no provisions for extending the photoreceptor life. Japanese Patent Application Laid-open Hei 8 No.106197 discloses an image forming apparatus of a multi layer transfer system wherein the amount of charge or volume resistivity of the toner is varied, step by step, one from another, from the preceding development and transfer process to the latter development and transfer process. This publication, however, is aimed at improvement of transfer performance for OHP sheets and involves no reference to the amount of photoreceptor wear and realization of simultaneous maintenance of the photoreceptors, which are the subject matter of the present invention.

Japanese Patent Application Laid-open Hei 9 No.319179 refers to a color image forming apparatus in which the amount of toner adherence at the preceding transfer step and that at the latter transfer step are controlled. This publication, however, is aimed at improvement of image quality against the reverse toner transfer problem and involves no reference to abrading force against the photoreceptor (or the speed of abrading the photoreceptor) and realization of simultaneous maintenance of the photoreceptors, which are the subject matter of the present invention.

SUMMARY OF THE INVENTION

It is therefore an object of the present invention to provide a color image forming apparatus which can solve the conventional problems stated above and enables the photoreceptors and toners for all colors to be used and have the same durability, needing a lower cost.

The inventors hereof have eagerly studied in view of the problems in the prior art and demands and found that the life of the photoreceptor for black development can be extended by keeping the abrading force (the speed at which the photoreceptor surface is worn away) of the black toner or the carrier used therewith if a dual-component developer is used, against the photoreceptor surface (coating film), lower than the abrading force of the other developing toners or their carriers, against the photoreceptor surfaces, and have successfully achieved the present invention. Accordingly, it becomes possible to make the speed at which each drum is worn away equal to that of the others, hence it is possible to avoid one drum alone being degraded in an early stage. As a result, it is possible to avoid the problem of failing to obtain good image quality due to a color imbalance between the drums, which would occur when only a single drum was replaced instead of replacing all the drums as used to be done in the conventional configuration. That is, the intervals for replacement of all the four drums are made equal, thus making it possible to avoid wasteful replacement.

A method for making the photoreceptor for black development different in the amount of abrasion from the photoreceptors for other developing colors can be achieved by controlling the abrading force of the toner against the photoreceptor surface, or by differentiating the indirect factors, i.e., the abrading force depending on the toner surface treating agent, the fluidity of the toner and/or the adhering amount of the toner onto the photoreceptor, between the black toner and the other developing toners. Another method can be achieved by making a distinction between the developing toners by making the developing toners different in hardness or using different binders having different hardnesses. Further, when dual-component developers are used, the amount of abrasion can be controlled by differentiating the abrading force of the carrier used with the toner against the photoreceptor coating and/or the adhered amount of the toner onto the photoreceptor, between the toner for black development and the other developing toners.

In the image forming apparatus according to the present invention, since it is not necessary to make the photoreceptor for black development different from the other developing photoreceptors, all the photoreceptors can be configured in a common configuration, which provides improved maintenance performance and a cost advantage.

To sum up, the image forming apparatus of the present invention is provided in the forms of the following configurations and structures.

(1) An image forming apparatus having a tandem system configuration, including: a multiple number of photoreceptors which each form an electrostatic latent image; and a multiple number of developing devices each holding a different color toner from the others for development of the corresponding static latent image, characterized in that the plural toners at least include a black toner, and the abrading force of the black toner against the photoreceptor surface is adjusted so as to be smaller than the abrading force of the other developing toners.

(2) The image forming apparatus defined in (1) above, characterized in that the multiple toners are configured so that each toner is externally added with a surface treating agent on the surface thereof and the abrading force of the black toner will be smaller than the abrading force of the other developing toners.

(3) The image forming apparatus defined in (2) above, characterized in that the amount of the surface treating agent added to each of the other developing toners is specified to be greater than the amount of the surface treating agent added to the black toner.

(4) The image forming apparatus defined in (2) or (3) above, characterized in that the surface treating agent consists of at least one or more kinds of additives, and the secondary particle size of the additive which is added in the black toner and presents the largest secondary particle size is smaller than the secondary particle size of the additive which is added in each of the other developing toners and presents the largest secondary particle size.

(5) The image forming apparatus defined in (4) as above, characterized in that the primary particle of the additive which is added in the black toner and presents the largest secondary particle size has a more rounded shape than the primary particle of the additive which is added in each of the other developing toners and presents the largest secondary particle size.

(6) The image forming apparatus defined in any one of (2) to (5) above, characterized in that $A<B$ holds where A represents the remaining ratio of the surface treating agent added in the black toner and B represents the remaining ratio of the surface treating agent added in the other developing toners.

(7) The image forming apparatus defined in any one of (2) to (6) above, characterized in that the surface treating agent added in the black toner consists of silica only while the surface treating agent added in the other developing toners consists of at least one of silica, titanium oxide, alumina and white organic fine particles.

(8) The image forming apparatus defined in (1) above, characterized in that the fluidity of the black toner is higher than the fluidity of the other developing toners.

(9) The image forming apparatus defined in (8) above, characterized in that the apparent density (AD) of the black toner is greater than the apparent density (AD) of the other developing toners.

(10) The image forming apparatus defined in (8) or (9) above, characterized in that the decay index (HB) of the black toner is smaller than the decay index (HC) of the other developing toners, where the decay index (H) is defined as the number of applications of tapping vibration to the compacted toner which was compressed while tapping, until the compressed toner decays.

(11) The image forming apparatus defined in (8) above, characterized in that the total added amount of wax in the black toner is lower than the total added amount of wax in each of the other developing toners.

(12) The image forming apparatus defined in (11) above, characterized in that the lowest peak temperature among the DSC peak temperatures of the wax in the black toner is higher than the lowest peak temperature among the DSC peak temperatures of the wax in the other developing toners.

(13) The image forming apparatus defined in (1) above, characterized in that, with the toners, the amount of the black toner adhering to the photoreceptor is lower than the amount of each of the other developing toners to the corresponding photoreceptor.

(14) The image forming apparatus defined in (13) above, characterized in that the absolute value of the amount of charge on the black toner is higher than the absolute value of the amount of charge on the other developing toners.

(15) The image forming apparatus defined in (13) or (14) above, characterized in that the volume resistivity of the black toner is higher than the volume resistivity of the other developing toners.

(16) The image forming apparatus defined in (1) above, characterized in that the binder resin contained in the black toner and the binder resin containers in the other developing toners are different in physical properties or type.

(17) The image forming apparatus defined in (16) above, characterized in that the durometer hardness of the black toner at normal temperature is lower than the durometer hardnesses of the other developing toners at normal temperature.

(18) The image forming apparatus defined in (17) above, characterized in that the durometer hardness of the binder resin contained in the black toner, at normal temperature is lower than the durometer hardness of the binder resin contained in the other developing toners, at normal temperature.

(19) The image forming apparatus defined in (18) above, characterized in that the durometer hardness of the binder resin contained in the black toner, at normal temperature is smaller by 10 or more in the durometer scale than the durometer hardness of the binder resin contained in the other developing toners, at normal temperature.

(20) The image forming apparatus defined in any one of (16) to (19) above, characterized in that the binder resin contained in the black toner is the same kind as the binder resin contained in the other developing toners, and the binder resin contained in the black toner has a smaller weight average molecular weight than the binder resin contained in the other developing toners.

(21) The image forming apparatus defined in (16) above, characterized in that the binder resin contained in the black toner is the same kind as the binder resin contained in the other developing toners, and the peak or shoulder of the binder resin contained in the black toner, which is located on the highest molecular weight side in the molecular weight distribution of the THF (tetrahydrofuran) solubles of the binder resin by GPC, exists at a position to the lower molecular weight side than the peak or shoulder of the binder resin contained in the other developing toners, which is located on the highest molecular weight side.

(22) The image forming apparatus defined in (16) above, characterized in that the binder resin contained in the black toner is the same kind as the binder resin contained in the other developing toners, and the THF insolubles of the binder resin contained in the black toner is smaller in quantity than the THF insolubles of the binder resin contained in the other developing toners.

(23) The image forming apparatus defined in (16) above, characterized in that the binder resin contained in the black toner is a non-cross-linked type resin while the binder resin contained in the other developing toners is a cross-linked type resin.

(24) The image forming apparatus defined in any one of (1) to (23) above, characterized in that each of the plural toners is used with a carrier so as to constitute a dual-component developer.

(25) The image forming apparatus defined in (24) above, characterized in that the black toner concentration upon development is lower than the concentration of the other developing toners.

(26) The image forming apparatus defined in (25) above, characterized in that the concentration of the black toner is lower by 0.5 to 2.0% than the concentration of the other developing toners.

(27) The image forming apparatus defined in (25) above, characterized in that the concentration of each of the multiple toners upon development falls within the range of 3 to 6%.

(28) An image forming apparatus having a tandem system configuration, including: a multiple number of photoreceptors which each form an electrostatic latent image; and a multiple number of developing devices each holding a different color toner from the others for development of the corresponding static latent image, characterized in that the plural toners at least include a black toner, and the abrading force of the carrier used with the black toner against the photoreceptor surface is adjusted so as to be smaller than the abrading force of the carrier used with the other developing toners against the photoreceptor surface.

(29) The image forming apparatus defined in (28) above, characterized in that the particle size of the carrier used with the black toner is smaller than the particle size of the carrier used with the other developing toners.

(30) The image forming apparatus defined in (29) above, characterized in that the mean particle size of the carrier used with the black toner is smaller by the range of 5 to 15 $\mu$m than the mean particle size of the carrier used with the other developing toners.

(31) The image forming apparatus defined in (28) above, characterized in that the particle size of the carrier used with each of the multiple toners falls within the range of 60 to 110 $\mu$m.

(32) The image forming apparatus defined in (28) above, characterized in that the saturation magnetization of the carrier used with the black toner is lower than the carrier used with the other developing toners.

(33) The image forming apparatus defined in (32) above, characterized in that the saturation magnetization of the carrier used with the black toner is lower by the range of 5 to 20 emu/g than the carrier used with the other developing toners.

(34) The image forming apparatus defined in (28) or (32) above, characterized in that the shape of the carrier used with the black toner is higher in sphericity than the shape of the carrier used with the other developing toners.

(35) The image forming apparatus defined in (28), (32) or (34) above, characterized in that the carriers used with the multiple toners all have the same or almost the same means particle size falling within a permissible range of ±0.5 $\mu$m, and the specific surface area of the carrier used with the black toner is smaller than the specific surface area of the carrier used in the other developing toners.

(36) The image forming apparatus defined in (28), (32), (34) or (35) above, characterized in that the current value of the carrier used with the black toner is lower than the current value of the carrier used with the other developing toners.

(37) The image forming apparatus defined in (36) above, characterized in that the current value of the carrier used with the black toner is lower by the range of 50 to 100 $\mu$A than the current value of the carrier used with the other developing toners.

(38) The image forming apparatus defined in (28), (32), (34), (35) or (36) above, characterized in that the carriers is composed of resin-coated cores, one or more kinds of cores, selected from iron powder, ferrite and magnetite, and the carrier used with the black toner has a different type of core from that of the carrier used with the other developing toner.

(39) A developer used in the image forming apparatus defined in (1), (2), (8), (16), (24), (28), (32), (34), (35), (36) or (38) above, characterized in that.

DESCRIPTION OF THE PREFERRED EMBODIMENTS

The embodiment of the present invention will hereinafter be described in detail.

The image forming apparatus of the present invention should not be limited to the embodiment described hereinbelow.

Figure 1:
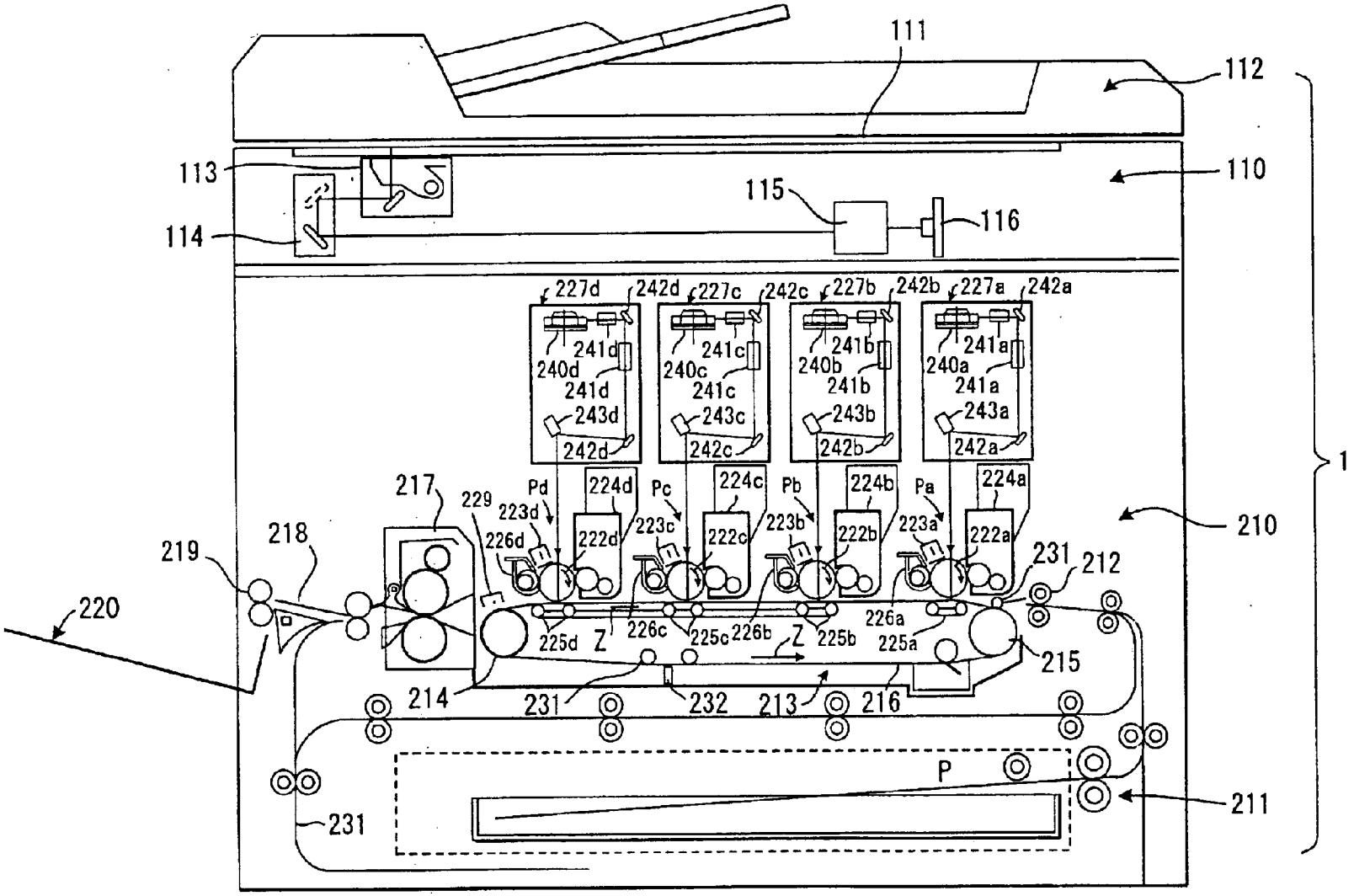
FIG. 1 is a view showing the overall configuration of a typical tandem type digital color copier.

As shown in FIG. 1, the image forming apparatus of the present invention is a tandem type system which includes: a multiple number of photoreceptors, each forming a static latent image; and developing devices each storing a different color of toner, for developing respective static latent images. When this machine is used for monochrome image forming other than color image forming, the machine is controlled in accordance with the control flowchart shown in FIG. 2. The image forming apparatus of the present invention has the features as follows.

Concerning the image forming apparatus according to the present invention, the aforementioned different colors of toners include a black toner. The toners for development used in the present invention may include toners of cyan, magenta, yellow and other colors, other than black toner. Specific compositions of the developing toners include the following components. It should be noted that the toner used here may be either mono-component developer or dual-component developer.

(Binder Resin)

As the binder resin, publicly known resins usually used for toner can be employed. Specific examples include: styrene resins such as polystyrene, polychlorostyrene, poly-$\alpha$-methyl styrene, styrene-chlorostyrene copolymer, styrene-propylene copolymer, styrene-butadiene copolymer, styrene-vinyl chloride copolymer, styrene-vinyl acetate copolymer, styrene-acrylic acid copolymer, styrene-acrylate copolymer, styrene-methacrylic acid copolymer, styrene-methacrylate copolymer, styrene-$\alpha$-chloromethyl acrylate copolymer and styrene-acrylonitrile-acrylate copolymer; vinyl chloride resin; rosin-modified maleic acid resin; phenol resin; epoxy resin; saturated polyester resin; unsaturated polyester resin; polyethylene resins such as polyethylene, ethylene-ethyl acrylate copolymer; polypropylene resin; ionomer resin; polyurethane resin; silicone resin; ketone resin; xylene resin; polyvinyl butyral resin; polycarbonate resin; and others, but the binder should not be particularly limited.

The above styrene resins are homopolymers or copolymers of styrene and/or its derivatives. Specific examples of styrene-acrylate copolymers include styrene methyl acrylate copolymer, styrene-ethylacrylate copolymer, styrene-butylacrylate copolymer, styrene-octylacrylate copolymer and styrene-phenylacrylate copolymer. Specific examples of styrene-methacrylate copolymers include styrene methylmethacrylate copolymer, styrene-ethylmethacrylate copolymer, styrene-butylmethacrylate copolymer, styrene-octylmethacrylate copolymer and styrene-phenylmethacrylate copolymer.

These binder resins may be used alone or in combination of two or more kinds. Of the above mentioned binder resins, styrene resins, saturated polyester resins and unsaturated polyester resins are especially preferable. The production method of the binder resin is not particularly limited.

(Coloring Agent)

As the coloring agent, publicly known pigments and dyes usually used for toner can be employed. Specific examples include: inorganic pigments such as carbon black, iron black, iron blue, chrome yellow, titanium oxide, zinc flower, alumina white, calcium carbonate; organic pigments such as phthalocyanine blue, victoria blue, phthalocyanine green, malachite green, hansa yellow G, benzidine yellow, lake red C, quinacridone magenta; organic dyes such as rhodamine dyes, triaryl methane dyes, anthraquinone dyes, monoazo dyes, diazo dyes; and others, but the coloring agent should not be particularly limited. These coloring agents maybe used alone or by appropriate combination depending on the color to which the toner is to be dyed. The coloring agent may be subjected to a publicly known pre-process such as a so-called master batch method or the like. The usage amount of the coloring agent is not particularly limited but an amount ranging from 1 part by weight to 25 parts by weight of the coloring agent is preferably added to 100 parts of the binder resin, and an amount ranging from 3 parts by weight to 20 parts by weight is more preferably added.

(Charge Control Agent)

As the charge control agent, examples of negative charging type compounds include monoazo metal compounds, organic metal compounds, chelate compounds, styrene-acrylic acid copolymers, styrene-methacrylic acid copolymers, aromatic hydroxy carboxylic acids, esters, phenol derivatives such as bisphenols, and others. Achromatic, hypochromatic charge control agents which will not affect the hue of the color toner are particularly preferred. Examples of negative charge control agents include organic metal complexes such as metal complexes of an alkyl substituted salicylic acid (for example, chromium complexes or zinc complexes of di-tertiary butyl salicylic acid). Examples of positive charge control agents include nigrosine dyes, triphenylmethane dyes, quaternary ammonium salts, imidazole compounds, metal salts of higher fatty acids, but the positive charge control agent should not be limited thereto. These charge control agents may be used alone or in combination, and an amount ranging from 0.1 part by weight to 20 parts by weight of the charge control agent is preferably added to 100 parts of the binder resin, and an amount ranging from 0.5 parts by weight to 10 parts by weight is more preferably added.

In order for the toner to be easily separated or peeled from the fixing roller or fixing belt, synthetic waxes such as polypropylene waxes, polyethylene waxes, etc., or petroleum waxes such as paraffin waxes and their derivatives, micro-crystalline waxes and their derivatives, their modified waxes, vegetable waxes such as carnauba wax, rice wax, candelilla wax, etc., may be used. Addition of wax provides sufficient separation performance, making it possible to prevent high-temperature and low-temperature offset.

The mixture of the above compositions is fused and kneaded by a kneading machine, and the resultant kneaded compound is rolled while cooling, coarse milled, and subjected to medium milling and fine milling by mechanical or impact type mills, and classified by air jet, in the well-known method. The thus classified particles are measured as to size by a Coulter Counter TA-II or Coulter Multisizer (products of Beckman Coulter, Inc.) to obtain toner particles having a volume average grain size ($D_{50}V$) of 5 to 15 $\mu$m.

(Surface Treating Agent)

Next, in order to provide aftermentioned fluidity and abrading and other functions to the obtained toner particles, achromatic or white organic or inorganic fine particles may be added as external additives (surface treatment agent) and dispersed and attached on the toner particle surfaces. An amount of 0.3 to 5 parts by weight of inorganic fine particles is preferably added to 100 parts of toner by weight.

Examples of organic fine particles include particles of acrylic resin, polyester resin, fluororesin, styrene resin and melamine resin.

Examples of inorganic fine particles include fine silica particles, fine titanium oxide particles, fine alumina particles. In particular, fine inorganic particles having a specific surface area ranging from 90 to 150 ($m^2/g$), measured by the BET nitrogen absorption method imparts beneficial results. Further, in order to make the fine inorganic particles hydrophobic and control their charge performance, the inorganic particles may be preferably treated, as required, by treating agents such as silicone varnishes, various modified silicone varnishes, silicone oil, various modified silicone oils, silane coupling agents, silane coupling agents having functional groups, other organic silicon compounds. For this treatment, two or more kinds of treating agents may be used. In particular, fine silica particles that have been surface-treated by a silicone oil and the like are preferably used. As other additives, lubricants such as Teflon(®), zinc stearate, poly vinylindene fluoride, silicone oil particles (containing about 40% silica) can be preferably used. Further, abrasives such as cerium oxide, silicon carbide, calcium titanate and strontium titanate are preferably used. A small amount of conductivity imparting agent such as zinc oxide, antimony oxide and tin oxide, which are white fine particles having an opposite polarity to that of the toner particles, may be added as an development enhancer.

In the image forming apparatus of the present invention, the abrading force of the black toner acting on the coating film over the photoreceptor surface is adjusted so as to be smaller than that of the other developing toners. That is, by reducing the abrading effect of the black toner compared to that of the other developing toners, the photoreceptor for black development is adapted to be less likely to be worn away to thereby extend the life of the photoreceptor for black development.

Figure 2:
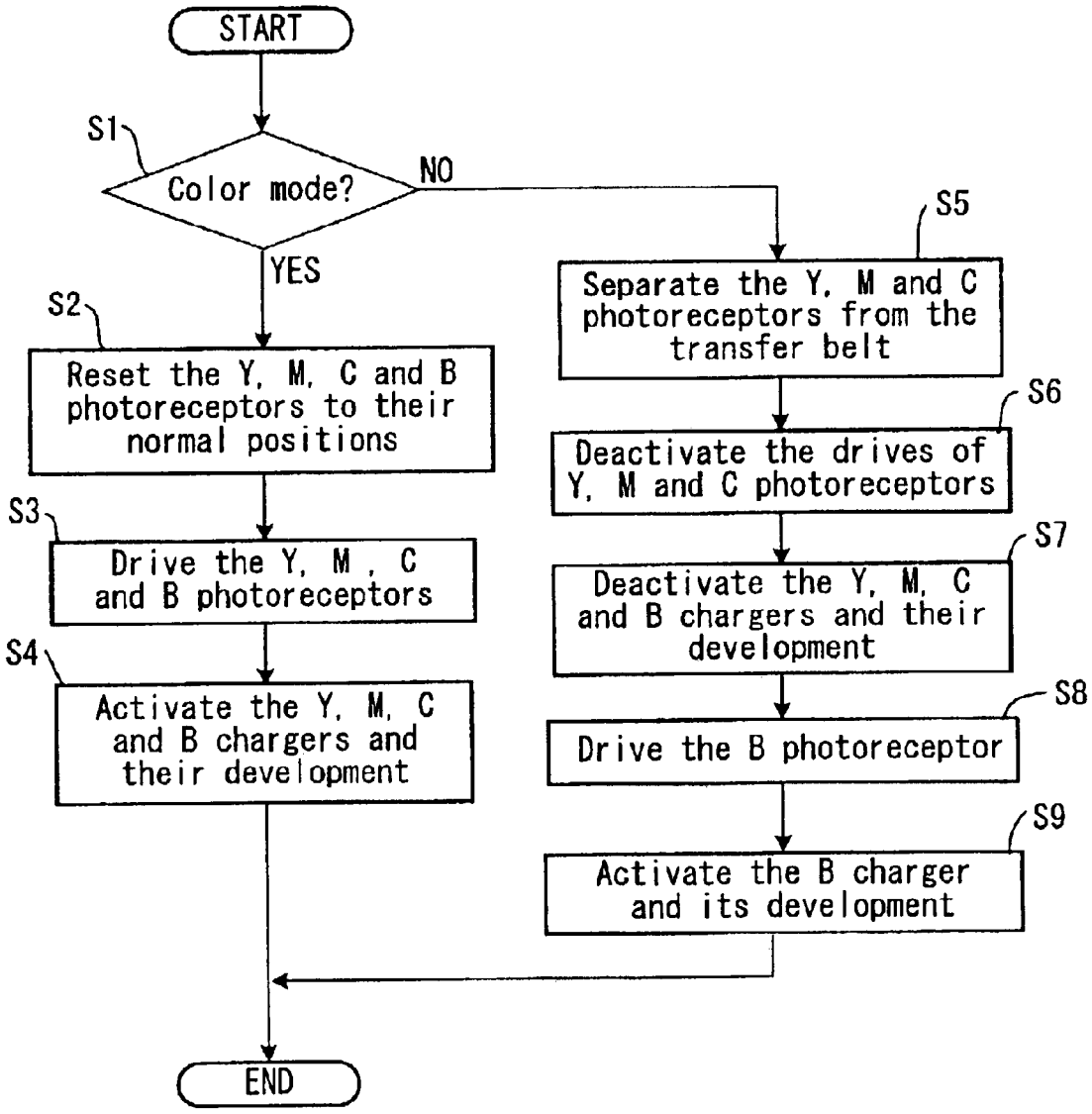
FIG. 2 is a flowchart showing the operational control implemented in the copier shown in FIG. 1.

More specifically, in the case where the abrading force of the black toner on the photoreceptor surface (or the speed at which the photoreceptor surface is worn away) is set to be smaller than that of the other developing toners for cyan, magenta and yellow in the image processing method shown in FIG. 2, if the photoreceptor for black development is used more often than the other photoreceptors, the photoreceptor for black development presents a similar durability (speed of abrasion) to that of the other photoreceptors because its speed of wear is slower than that of the other photoreceptors.

In order to reduce the abrading force of the black toner on the photoreceptor surface in the above way, it is preferred that the toners specified below are used.

As described above, in the image forming apparatus according to the present invention a surface treating agent is attached to the surface of each toner used, and it is possible to make the abrading force of the black toner smaller than the abrading force of the other developing toners, by controlling the amount and properties of the surfactant.

First, this can be achieved by adjusting the amount of the surface treating agent added to each of the other developing toners so as to be greater than the amount of the surface treating agent added to the black toner. Alternatively, this can be done by composing the surface treating agent with at least one or more kinds of additives and adjusting the secondary particle size of the additive which is added in the black toner and presents the largest secondary particle size so as to be smaller than the secondary particle size of the additive which is added into each of the other developing toners and presents the largest secondary particle size. Another method for the above purpose can be achieved by making the primary particle of the additive which is added in the black toner and presents the largest secondary particle size have a more rounded shape than the primary particle of the additive which is added in each of the other developing toners and presents the largest secondary particle size.

Concerning the physical properties of the surfactant, $A<B$ should hold where A represents the ratio of the surface treating agent added in the black toner remaining after sifting by a sieve having a predetermined mesh size and B represents the ratio of the surface treating agent added in the other developing toners remaining on the same sieve.

Concerning selection of the material composition of the surface treating agent, it is preferred that the surface treating agent added in the black toner consists of silica only while the surface treating agent added in the other developing toners consists of at least one of silica, titanium oxide, alumina and white organic fine particles.

In general, the lower the added amount of the surface treating additives attached to the toner surface is, the lower abrading effect on the coating film of the photoreceptor surface is. The lower the agglutinative ability of the added surface treating agent is or the smaller the secondary particle size of the surface treating agent is, the lower is the abrading force against the coating film or the like on the photoreceptor surface. Further, the lower the degree of detachment of the added surface treating agent from the toner surface (the remaining ratio after sifting by a sieve having a predetermined mesh size) is, the lower is the abrading force against the coating film or the like on the photoreceptor surface. Furthermore, the abrading effect against the coating film and the like on the photoreceptor surface becomes greater as additives having a greater primary particle size other than silica are added as the surface treating agent. These setups of the surface treating agent may be used alone or in combination, whereby it is possible to control the abrading performance of the toner on the coating film of the photoreceptor in a good enough manner. Therefore, in the present invention, the photoreceptor for black development can exhibit durability (an amount of wear) approximately equal to that of the other photoreceptors.

Further, in order to decrease the abrading force of the black toner against the photoreceptor surface, it is preferred that the fluidity of the black toner is higher than that of the other developing toners. When the fluidity of the black toner is adjusted so as to be higher than that of the other developing toners, it is possible to reduce stagnation of the toner in the cleaner unit for collecting the leftover toner on the photoreceptor whereby it is possible to reduce the abrading force against the surface of the photoreceptor surface for black development.

As the indexes for determining the toner's fluidity, the toner's apparent density (AD) and the decay index (H), representing the easiness of decay of the compacted toner obtained after tapping, can be mentioned because, in general, the apparent density becomes higher and the decay index becomes lower as the fluidity is higher.

Therefore, it is preferred that the apparent density (AD) of the black toner is greater than the apparent density (AD) of the other developing toners. It is also preferred that the decay index (HB) of the black toner is smaller than the decay index (HC) of the other developing toners. Here, the decay index (H) is defined as the number of applications of tapping vibration to the compacted toner which was compressed while tapping, until the compressed toner decays.

It is also possible to control the fluidity of a toner by differentiating the type of wax, the added amount of wax and the detachability of the wax.

It is preferred that the total added amount of wax in the black toner is lower than the total added amount of wax in each of the other developing toners. Concerning the wax properties, it is also preferred that the lowest peak temperature among the DSC peak temperatures of the wax in the black toner is higher than the lowest peak temperature among the DSC peak temperatures of the wax in the other developing toners.

This is because the fluidity of a toner generally becomes poor as the DSC peak temperature of the wax lowers and the sharpness of the peak is weaker. The greater the added amount of wax to the toner, the higher is the probability of the wax existing on the toner surface, hence the fluidity of the toner becomes poor.

Further, in order to decrease the abrading force of the black toner against the photoreceptor surface, it is preferred that, with the toners, the amount of the black toner adhering to the photoreceptor is lower than the amount of each of the other developing toners to the corresponding photoreceptor.

It is possible to decrease the abrading force against the photoreceptor for black development compared to that on the other developing photoreceptors, by making the amount of the black toner adhering to the photoreceptor lower than that of the other developing toners.

With concern to the specific control, as the amount of charge on the toner is increased and the volume resistivity of the black toner is increased, the amount of toner adhering onto the photoreceptor can be reduced. Accordingly, it is preferred that the amount of charge on the black toner is higher than the amount of charge on each of the other developing toners.

Next, it is possible to make the abrading force of the black toner against the photoreceptor surface smaller than that of the other developing toners, by appropriate selection of the above-described binder resin contained in the toners.

That is, in the image forming apparatus according to the present invention, it is preferred that the binder resin contained in the black toner and the binder resin contained in the other developing toners are different in physical properties or type.

For example, when the toners are prescribed so that the durometer hardness of the black toner at normal temperature is lower than the durometer hardnesses of the other developing toners at normal temperature, it is possible to make the abrading force of the black toner against the photoreceptor surface smaller than that of the other developing toners.

In this case, it is preferred that the durometer hardness of the binder resin contained in the black toner, at normal temperature is lower than the durometer hardness of the binder resin contained in the other developing toners, at normal temperature. It is especially preferred that the durometer hardness of the binder resin contained in the black toner, at normal temperature is smaller by 10 in the durometer scale than the durometer hardness of the binder resin contained in the other developing toners, at normal temperature.

The binder resin used for the black toner and the binder resin contained in the other developing toners may be the same kind of resin or may differ in kind from each other as long as the durometer hardness of the binder resin contained in the black toner is lower than the durometer hardness of the binder resin contained in the other developing toners. The binder resin may be composed of one kind only or of two or more kinds in combination. When two or more kinds of resins are used in combination, the durometer hardness of the binder resins contained in the black toner, as a whole, needs to be lower than the durometer hardness of the binder resins, as a whole, contained in the other developing toners.

Specific adjustment of the hardness of each toner can be made by controlling the hardness of the binder resin. The hardness of the binder resin varies depending on the kind of resin, the molecular weight of the resin, the amount of THF(tetrahydrofuran) insolubles of the binder resin, the degree of cross-linking. Generally, for binder resins of the same kind, one having a higher molecular weight is harder, one containing a greater amount of THF insolubles is harder, and one exhibiting a higher degree of cross-linking is harder.

As a specific example meeting these conditions, it is preferred that the binder resin contained in the black toner is a non-cross-linked type resin while the binder resin contained in the other developing toners is a cross-linked type resin.

The aforementioned hardness of the toner and the hardness of the binder resin can be measured by a durometer. The durometer hardness is measured under a temperature from 21 to 25° C., conforming to JISK 6253-1997. The durometer hardness is represented by a numeral ranging from 0 to 100, higher numbers indicating increasing hardness. The condition that the durometer hardness of the binder resin contained in the black toner at normal temperature is lower than the durometer hardnesses of the binder resin contained in the other developing toners at normal temperature, means that the binder resin contained in the other developing toners is harder than the binder resin contained in the black toner. Therefore, the other developers result in being harder, so as to present a stronger abrading force on the photoreceptor surfaces. In order to create a significant enough difference in toner abrading force, it is preferred as stated above that the durometer hardness of the binder resin contained in the black toner, at normal temperature is smaller by 10 or more in the durometer scale than the durometer hardness of the binder resin contained in the other developing toners, at normal temperature.

The binder resin needs to have a high enough harness at normal temperature. Specifically, the binder resin preferably has a durometer hardness of 70 or greater at normal temperature. If the durometer hardness at normal temperature is lower than 70, there is a risk that the toner may be deformed by the pressure and shearing force from the carrier when the toner is mixed with the carrier in the developing device, possibly causing failure in holding stable charge-development characteristics. Further, there is also a risk that when the toner on the photoreceptor is cleaned, the toner may be deformed by the shearing force from the cleaning blade, causing cleaning defects.

Accordingly, in the present invention, the durometer hardness of the materials other than the binder resin may be not greater than 70, but the durometer hardness of the black toner, as a whole, at normal temperature should be smaller than the durometer hardness of the other developing toners at normal temperature. Yet, it is preferred that the durometer hardness of the black toner at normal temperature is equal to or greater than 70.

In the present invention, when the binder resin contained in the black toner is the same kind as the binder resin contained in the other developing toners, it is preferred that the binder resin contained in the black toner has a smaller weight average molecular weight than the binder resin contained in the other developing toners.

The greater the weight average molecular weight, the harder the binder resin is. If the weight average molecular weight of the binder resin contained in the black toner is smaller than that of the binder resin contained in the other developing toners, the binder resin contained in the other developing toners is harder than the binder resin contained in the black toner. Resultantly, the other developing toners become harder and hence exhibit a greater abrading force on the photoreceptors.

Further, according to the present invention, it is preferred that the binder resin contained in the black toner is the same type as the binder resin contained in the other developing toners, and the peak or shoulder of the binder resin contained in the black toner, which is located on the highest molecular weight side in the molecular weight distribution of the THF (tetrahydrofuran) solubles of the binder resin by GPC (gel permeation chromatography), exists at a position to the lower molecular weight side than the peak or shoulder of the binder resin contained in the other developing toners, which is located on the highest molecular weight side.

The condition that the peak or shoulder of the binder resin contained in the black toner exists at a position to the lower molecular weight side than that of the binder resin contained in the other developing toners means that the binder resin contained in the other developing toners includes greater amounts of high-molecular weight components than the binder resin contained in the black toner, hence is harder. As a result, the other developing toners become harder and hence present greater abrading forces against the photoreceptor surfaces.

In the present invention, the molecular weight at the peak and/or at the shoulder by the chromatogram of a GPC analysis can be measured under the following conditions.

A column is stabilized in the heat chamber at a temperature of 40° C. While THF (tetrahydrofuran) is made to flow at a flow rate of 1 ml per minute as a solvent through the column set at the aforementioned temperature, a 50 to 200 μl THF sample solution with its concentration of a sample binder resin adjusted to 0.05 to 0.6 wt. % is injected for the measurement.

Upon measurement of the molecular weight of the sample, the molecular weight distribution of the sample is calculated based on the relationship between the logarithm of the calibration curve plotted based on the standard samples of plural kinds of monodisperse polystyrenes and the count value. For plotting the calibration curve, at least 10 types of standard polystyrene samples should be used. As examples of the standard polystyrene samples, polystyrenes having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.8\times10^6$, manufactured by Pressure Chemical Co. or manufactured by Toyo Soda Manufacturing Company, Ltd., for example, may be used. For the detector, a RI (refraction index) detector may be used.

It is also preferred that the THF insolubles of the binder resin contained in the black toner is smaller in quantity than the THF insolubles of the binder resin contained in the other developing toners.

The THF insolubles of the resin in the present invention means the impermeant component through filter paper when the sample is dissolved in THF (tetrahydrofuran), and can be determined in the following manner.

(1) A 200 to 300 mg sample put directly in a 25 ml conical flask with 20 ml THF added therein is left over night.

(2) The content of the conical flask is put into a centrifugal separator tube of Teflon(®).

(3) The conical flask of (1) is rinsed out with 20 ml THF, and the liquid is added to the above centrifugal separator tube, so that the total amounts to 40 ml. Then the tube is sealed by Sealon film (a trade name: a product of Fuji Photo Film Co., Ltd.).

(4) For centrifugal separator, the centrifugal separator tube is rotated at 18,000 rpm in a temperature of −10° C. for 20 minutes.

(5) the centrifugal separator tube is taken out and left until it reaches room temperature.

(6) A 5 ml supernatant liquid in the centrifugal separator tube is taken and put into an aluminum plate whose weight is known, and the solvent THF is evaporated by a hot plate.

(7) The sample held in the aluminum plate is put in a vacuum dryer set at 50° C. and dried over night. The weight including the aluminum plate is measured so as to obtain the amount of THF solubles in 5 ml.

(8) The THF insolubles are calculated in the following formula:

THF insolubles (%)=(<sample weight>−[(<THF solubles+aluminum plate weight>−<aluminum plate weight>)×40/5])÷<sample weight>×100

The THF insolubles represent the ultrahigh molecular weight components of the binder resin. Since the molecular weight distribution obtained by GPC comes up with the THF solubles only, it does not provide any information about THF insolubles. The greater the amount of THF insolubles contained in a resin, the greater is the average molecular weight of the whole resin. So, the resin or toner becomes harder and hence the abrading force acting on the photoreceptor becomes greater. Therefore, when the amount of the THF insolubles in the binder resin for black toner is adjusted so as to be smaller than that of the amount of the THF insolubles in the binder resin for the other developing toners, the abrading force of the black toner becomes weaker than the abrading force of the other developing toners. In order to create a significant enough difference in toner abrading force between the black toner and the other developing toners, it is preferred that the amount of the THF insolubles of the binder resin contained in the black toner is smaller by 10 wt. % than the amount of the THF insolubles of the binder resin contained in the other developing toners.

When dual-component developers are used, the image forming apparatus according to the present invention can be characterized in that the abrading force of the carrier used with the black toner acting on the photoreceptor surface is adjusted so as to be smaller than the abrading force of the carrier used with the other developing toners. Further, in this case, it is possible to differentiate the abrading forces against different photoreceptors by adjusting the toner concentration.

That is, the developing toners of the present invention are toners for dual-component developers, and can be achieved by adjusting the concentration of the black toner in the developer so as to be lower than the toner concentration of the other developing toners during so-called stabilized processing state (during development). Further, a systematic configuration of dual-component developers presenting characteristics that the abrading force from contact of the carrier used with the black toner acting on the photoreceptor is smaller than the contact abrading force from contact of the carrier used with the other developing toners acting on the photoreceptors, can be achieved by differentiating the carriers in the form, current value, resistivity and other factors, between the carriers. As a result, it is possible to extend the lifetime of the photoreceptor for black development compared to that of the other photoreceptors.

In the present invention, the core material of the carrier can be selected from iron powder, ferrite and magnetite. The manufacturing method of the carriers of the present invention will be briefly described taking an example of a ferrite carrier. However, the present invention should not be limited to the following method, and any method can be used as appropriate for manufacturing core material without any particular restrictions.

A ferrite carrier generally has the following chemical composition:

$$(MnO)x(MgO)y(Fe_2O_3)z.$$

In the above expression, x+y+z=100 mol %. For a basic composition, x, y and z are preferably specified within the ranges, 3 to 35 mol %, 10 to 45 mol % and 45 to 55 mol %, respectively. The above oxides are compounded in their appropriate amounts and the mixture is crushed and mixed by a wet or dry type ball mill, sand mill, vibrating mill or other mills, for one hour or longer, preferably one to twenty hours. The thus crushed material is granulated and temporarily baked at 700 to 1200° C. In some cases, this temporary baking step may be omitted. After temporary baking, the material is crushed by a wet type ball mill, wet type sandmill, wet type vibrating mill or the like, and the resultant is added with a dispersant, binder and other additives, as required. After the viscosity of the mixture is adjusted, the compound is granulated and baked at a temperature of 1000 to 1500° C., perferably at 1200 to 1500° C., for one to twenty-four hours.

The baked material thus obtained from the above process is separated and pulverized and graded to prepare particles of a desired particles size. The mean particle size is preferably specified to 20 to 200 $\mu$m. The particle size of the carrier of the present invention can be measured based on the method conforming to JIS-H2601.

For adjustment of saturation magnetization, the compounding ratio, i.e., x, y and z in the above general expression can be varied appropriately. Alternatively, the baking atmosphere may be controlled for this purpose. The saturation magnetization of the carrier of the present invention can be determined from the hysteresis curve measured in a magnetic field of ±1 kilo-oersted by a DC magnetization characteristic automatic recorder (3257-35 type: a product of Yokogawa Electric Corporation).

The surface treatment and shaping of the carrier in the present invention can be performed chemically or mechanically or by combination of these. A typical chemical process is oxidation in a vapor phase or in a liquid phase. More specifically, oxidation processes such as air oxidation and oxidation with chemicals can be mentioned. Mechanical methods include application of friction, collision and impacts. More detailedly, a pin mill, V-type blender, sand mill, Henschel type mixer, kneader and others can be used. The surface conditions and shape of the processed carrier can be observed by aSEM or others. The specific surface area of the carrier of the present invention can be measured by the BET method.

As the coating resin used in the present invention, various materials can be used depending on the required charge performance. A single resin may be selected or two or more kinds of resins may be mixed. Specific examples of coating resins include silicone resins (silicone resin and its derivatives), fluororesins, styrene resins, acrylic resins, methacrylic resins, polyester resins, polyamide resins, phenol resins. These can be used as copolymers and there is no limitation for their usage.

The way of coating the resin is not particularly limited. Though an appropriate method can be selected, the resin coating is usually implemented as follows. First, the aforementioned resin is diluted or dispersed in methylethyl ketone, tetrahydrofuran, toluene or other solvents or a mixed solvent of these so as to prepare a resin solution. Then, the resin layer is formed by immersing the core material into the resin solution or by spraying the resin solution over the core material which has been fluidized beforehand. Thereafter, it is preferred that while fluidized the core material is heated at 50 to 300° C. for about 30 to 60 minutes. The coated amount of resin is preferably specified to the range of 0.05 to 5 wt. % with respect to the core material.

The current value of the carrier of the present invention can be measured by the following method. A 1000 g carrier is exposed under a room environment at a temperature of 20 to 26° C. and at a relative humidity of 50 to 60% for 15 minutes or longer, then is put into a magnetic brush. With an applied voltage of 200 V and the current range set 50 $\mu$A, the current value is measured.

Generally, the charge amount on the toner will increase as the concentration of the toner in a developer containing a carrier is lowered. Therefore, it is possible to control the amount of the toner adhering to the photoreceptor. When the toner concentration in the developer is high, problems such as toner scatter or background fog may occur. On the other hand, when the toner concentration is low, problems such as low image density may occur.

Further, when the concentration of the black toner is lower than the concentration of the other developing toners as described above and the difference is smaller than 0.5%, the effect of the present invention cannot be expected. When the difference exceeds 2.0%, a great difference in image characteristics between black and the other colors occurs, producing an unpreferable result.

Accordingly, in the present invention, it is preferred that the concentration of the black toner in the developer is lower by 0.5 to 2.0% than the concentration of the other developing toners. It is also preferred that the concentration of each of the multiple toners in the developer falls within the range of 3 to 6%.

By providing a systematic configuration of developers presenting the characteristics whereby the abrading force from contact of the carrier used with the black toner acting on the photoreceptor is smaller than the abrading force from contact of the carrier used with the other developing toners acting on the photoreceptors, it is possible to extend the lifetime of the photoreceptor for black development. Further, by reducing the current value through the carrier in the developer, the carrier resistivity is increased. As a result, the amount of charge on the toner in the developer can be increased, whereby the toner adherence onto the photoreceptor can be regulated.

In this way, the abrading force of the carrier in contact with the photoreceptor coating film can be controlled by the following methods.

Making the particle size of the carrier smaller increases the flexibility of the carrier brush and increases the amount of charge on the toner in the developer hence the adherence to the photoreceptor can be regulated. Accordingly it is possible to suppress the abrading effect on the photoreceptor.

Therefore, the present invention can be characterized in that the particle size of the carrier used with the black toner is smaller than the particle size of the carrier used with the other developing toners.

When the carrier particle size is small, carrier transfer to the photoreceptor is liable to occur. In contrast, a large carrier particle size is disadvantageous in electrification of charge on the toner, hence liable to cause image quality problems in an environment with high temperature and high humidity. Further, when the particle size of the carrier used with the black toner is smaller than that of the carrier used with the other developing toners with its difference smaller than 5 $\mu$m, the effect of the present invention cannot be expected. When the difference exceeds 15 $\mu$m, a great difference in image characteristics between black and the other colors occurs, producing an unpreferable result. Accordingly, it is preferred in the present invention that the mean particle size of the carrier used with the black toner is smaller by the range of 5 to 15 $\mu$m than the mean particle size of the carrier used with the other developing toners. It is also preferred that the particle size of the carrier used with each of the multiple toners falls within the range of 60 to 110 $\mu$m.

Moreover, reduction of the saturation magnetization of the carrier makes the carrier brush length short. As a result, the contact area between the carrier and the photoreceptor coating film is reduced, whereby the abrading force against the photoreceptor can be suppressed.

In order to adjust the durability (the amount of wear) of the photoreceptor for black development so as to be approximately equal to that of other photoreceptors, the present invention may be characterized in that the saturation magnetization of the carrier used with the black toner may be lower than the carrier used with the other developing toners.

When the saturation magnetization of the carrier for the black toner is lower than that of the carrier for the other developing toners with its difference smaller than 5 emu/g, the full effect of the present invention cannot be expected. When the difference exceeds 20 emu/g, a great difference in image characteristics between black and the other colors may occur. Accordingly, it is preferred that the saturation magnetization of the carrier used with the black toner is lower by the range of 5 to 20 emu/g than the carrier used with the other developing toners.

Since contact of the carrier on the photoreceptor can be made smooth when the carrier shape is made close to spherical or when the surface condition of the carrier is made smooth, it is possible to regulate the abrading force acting on the photoreceptor.

In order to adjust the durability (the amount of wear) of the photoreceptor for black development so as to be approximate equal to that of other photoreceptors, the present invention may be characterized in that the shape of the carrier used with the black toner may be higher in sphericity than the shape of the carrier used with the other developing toners.

Here, when different types of carriers having an approximately equal weight avenge particle size, within the range of ±0.5 $\mu$m, the carrier presenting a smaller specific area must have a smooth surface. Accordingly, the present invention can be characterized in that, when the carriers used with the multiple toners all have the same or almost the same mean particle size falling within a permissible range of ±0.5 $\mu$m, the specific surface area of the carrier used with the black toner is smaller than the specific surface area of the carrier used in the other developing toners. Further, the present invention can be also characterized in that the carriers are composed of resin-coated cores, one or more kinds of cores, selected from iron powder, ferrite and magnetite, and the carrier used with the black toner has a different type of core from that of the carrier used with the other developing toner. By this limitation, it is possible to differentiate the carriers in smoothness, hence it is also possible to expect a good enough effect of the present invention.

In order to adjust the durability (the amount of wear) of the photoreceptor for black development so as to be approximate equal to that of other photoreceptors, the present invention may be characterized in that the current value of the carrier used with the black toner is lower than the current value of the carrier used with the other developing toners.

This is because the resistivity of the carrier is increased by reducing the current value of the carrier in the developer, and the amount of charge on the toner in the developer increases, whereby the amount of toner adherence to the photoreceptor can be controlled.

In this case, it is preferred that the current value of the carrier used with the black toner is lower by the range of 50 to 100 $\mu$A than the current value of the carrier used with the other developing toners.

As has been described heretofore, the speeds at which the drums are worn away can be made equal, by the following methods:—

(1) control of differentiating the abrading force of the toner itself acting on the photoreceptor surface, or the direct abrading force from the surface treating agent, the toner fluidity and the amount of toner adherence onto the photoreceptor, between the black toner and the other developing toners;

(2) control of differentiating the developing toners by making the hardness of the toner or the hardness of the binder resin different, between the black toner and the other developing toners; and (3) control of differentiating the abrading force of the carrier itself acting on the photoreceptor surface and/or the amount of toner adherence onto the photoreceptor, between the black toner and the other developing toners. As a result, it is possible to avoid the problem of failing to obtain good image quality due to a color imbalance between the drums, which would occur when only a defective single drum was replaced instead of replacing all the drums. That is, the intervals for replacement of all the four drums are made equal, thus making it possible to avoid wasteful replacement.

Concerning the specifications of the toners in the actual configuration, it is preferred that the materials and manufacturing method of the toners are selected appropriately based on the expected usage frequency ratio between monochrome image mode and color image mode and by calculating the amount of wear of the photoreceptors to be used.

EXAMPLES

Specific description will be made with reference to the examples of the present invention and comparative examples, but the present invention should not be limited to these examples.

(1) Examples 1 to 12 and Comparative Examples 1 to 5 Depending on the Difference of the Surface Treating Agent to be Externally Attached to the Toner First, the toners used for the examples and comparative examples were prepared.

(Toner Preparation)

An amount of 94 parts by weight of polyester resin as a binder resin, 2 parts by weight of metal salt of alkyl salicylic acid as a charge control agent, 4 parts by weight of a coloring agent selected from the following cyan, magenta and yellow coloring agents or 6 parts by weight of carbon black as a coloring agent for black, and 3 parts by weight of carnauba wax A as a separating agent were mixed by a Henschel mixer, then the mixture was fused and kneaded using a biaxial extrusion type kneader. The resultant was pulverized by jet milling so that the grains were graded so as to prepare a developing toner having a mean particle size of 8 μm. In this way, four colors of developing toner were prepared.

<Coloring Agents>

Cyan (C): C. I. Pig. B-15

Magenta (M): C. I. Pig. R-122

Yellow (Y); C. I. Pig. Y-17

Further, hydrophobic silica as a toner surface treating agent, as prescribed in Table 1 was added to each toner and then mixed by a Henschel mixer for additive attachment.

Each of the obtained color toners was mixed with a ferrite carrier by a Nauta mixer, so as to provide a dual-component developer having a toner concentration of 5%. In Table 1, the silica shape was determined by observing the images taken by an electron microscope.

TABLE 1

| Toner type | Silica type | Silica primary particle size(nm) | Silica secondary particle size (μm) | Added amount (wt %) | Silica shape |
|---|---|---|---|---|---|
| Yellow · | A | 15 | 0.1 | 1 | irregular |
| Magenta · | B | 40 | 3.0 | 1 | irregular |
| Cyan | | | | | |
| Black | A | 15 | 0.1 | 0.8 | irregular |
| Toner 1 | B | 40 | 3.0 | 0.8 | irregular |
| Black | A | 15 | 0.1 | 1 | irregular |
| toner 2 | C | 45 | 1.5 | 1 | irregular |
| Black | A | 15 | 0.1 | 1 | irregular |
| toner 3 | D | 50 | 3.0 | 1 | spherical |
| Comparative | A | 15 | 0.1 | 1 | irregular |
| black toner 1 | B | 40 | 3.0 | 1 | irregular |

Examples 1–3•Comparative Example 1

As shown in Table 1, a black toner 1 of example 1 was prepared so that the amount of the surface treating agent in the black toner 1 was made different from the amount of the surface treating agent in the Y, M and C color toners (a common condition for the examples and comparative example). After a running test of 100,000 copies in the usual usage mode was carried out in a full-color copier AR-C150 (a product of Sharp Corporation) illustrated in FIG. 1, with the toner of example 1, the film thickness of each photoreceptor after being worn down was measured. The result is shown in Table 2. The result showed that all the photoreceptors reduced in film thickness to almost the same degree. The usual usage mode mentioned here was set so that the ratio between the full-color mode usage and the monochrome mode usage became 3:2. The film thickness of each photoreceptor at the start was 25 μm.

Similarly, a black toner 2 of example 2 was prepared so that the secondary particle size of the surface treating agent was made different from that of the surface treating agent in the color toners, and a black toner 3 of example 3 was prepared so that the primary particle size of the surface treating agent was made different. In both cases, the result showed that all the photoreceptors reduced in film thickness to almost the same degree, as seen in Table 2.

In contrast, in comparative example 1, a comparative black toner 1 was prepared so that the same amounts of the surface treating agents as in the color toners were added. As a result, a difference in film thickness was recognized between that of the photoreceptor for black development and that of the others, as seen in Table 2.

TABLE 2

| Applied photoreceptor type | for yellow | for magenta | for cyan | for black |
|---|---|---|---|---|
| Example 1 | 12.2 μm | 12.3 μm | 12.2 μm | 12.1 μm |
| Example 2 | 12.1 μm | 12.3 μm | 12.2 μm | 12.2 μm |
| Example 3 | 12.2 μm | 12.2 μm | 12.1 μm | 12.0 μm |
| Comp. example 1 | 12.3 μm | 12.2 μm | 12.2 μm | 10.3 μm |

Film thickness of each photoreceptor after a 100,000 copy run (25 μm at the start)

Example 4•Comparative Example 2

A black toner 4 was prepared as example 4 on the basis of the black toner 1 in example 1, by adding 0.8 part by weight of silica D having a primary particle size of 50 nm, instead of adding silica B in the additive compositions of the black toner 1.

When each toner, namely the black toner 4, Y, M and C toners in example 1 and comparative black toner 1, was sifted through a #400 sieve under vibration, the ratios (a/b) of the amount a of the additive left over on the mesh(sieve) to the total amount b of the additive added to the toner are shown in Table 3. After a running test of 100,000 copies in the image forming apparatus with the toner of example 4, the film thickness of each photoreceptor reduced as Table 3. (Here, the ratio of the additive trapped on the mesh for black toner is represented by A, the ratio of the additive trapped on the mesh for the other developing colors is represented by B (By for yellow, Bm for magenta and Bc for cyan). When the proportion of the amount of the additive remaining on the mesh after sifting, in other words, the proportion of the amount of the additive falling off from the toner surface, was adjusted so as to be lower in the black toner than in the other developing toners, the result showed that the coatings of all the photoreceptors reduced in film thickness to almost the same degree, after a large volume coping operation.

In contrast, comparative example 2 used toner having the same toner composition as comparative example 1, and the amount of the additive remaining on the mesh of the comparative black toner 1 was approximately equal to that of the other colors. The result showed that only the photoreceptor for black development reduced in film thickness to a greater degree.

TABLE 3

| Applied photoreceptor type | | for yellow | for magenta | for cyan | for black |
|---|---|---|---|---|---|
| Example 4 | a/b | By = 0.08 | Bm = 0.10 | Bc = 0.09 | A = 0.01 |
| | Film thickness | 12.3 μm | 12.2 μm | 12.2 μm | 12.2 μm |
| Comp. example 2 | a/b | By = 0.09 | Bm = 0.10 | Bc = 0.10 | A = 0.10 |
| | Film thickness | 12.3 μm | 12.2 μm | 12.2 μm | 10.3 μm |

Film thickness: coating film thickness on the photoreceptor, a/b: (the amount of the additive remaining on the mesh)/(the total added amount of the additive)

Example 5•Comparative Example 3

With a black toner and developing toners for colors other than black having the following compositions of example 5 shown in Table 4 below, a 100,000 copy run as explained above caused approximately uniform reduction in film thickness for all the photoreceptors. On the other hand, when all the four color toners were adjusted to have the same additive compositions, only the photoreceptor for black development reduced in film thickness to a greater degree (comparative example 3).

TABLE 4

| | | Additive 1 | | Additive 2 | | Coating film |
|---|---|---|---|---|---|---|
| Item | Toner type | Type | Added amount | Type | Added amount | thickness on photoreceptor |
| Example 5 | Yellow 2 | Silica A | 1.0 wt. % | Titanium oxide | 0.5 wt. % | 12.1 μm |
| | Magenta 2 | Silica A | 1.0 wt. % | Titanium oxide | 0.5 wt. % | 12.2 μm |
| | Cyan 2 | Silica A | 1.0 wt. % | Titanium oxide | 0.5 wt. % | 12.1 μm |
| | Black toner 2 | Silica A | 1.0 wt. % | Silica C | 1.0 wt. % | 12.2 μpm |
| Comp. Example 3 | Yellow 2 | Silica A | 1.0 wt. % | Titanium oxide | 0.5 wt. % | 12.1 μm |
| | Magenta 2 | Silica A | 1.0 wt. % | Titanium oxide | 0.5 wt. % | 12.2 μm |
| | Cyan 2 | Silica A | 1.0 wt. % | Titanium oxide | 0.5 wt. % | 12.1 μm |
| | Comp. black toner 2 | Silica A | 1.0 wt. % | Titanium oxide | 0.5 wt. % | 10.5 μm |

Example 6•Comparative Example 4

Selection of the silica type for black toner and the other developing toners, or a differentiation of additive prescription can produce a difference between the fluidity of the black toner and that of the other developing toners, whereby it is possible to differentiate the stagnation of the toner which has been left over on the photoreceptor and collected by the cleaning unit. That is, by adjusting the fluidity of the black toner to be higher than that of the other developing toners, the abrading effect on the photoreceptor coating film, attributed to the collected toner of the black toner can be suppressed in a greater degree for the black toner than for the other developing colors.

A similar 100,000 copy run was implemented using a black toner 5 prescribed as in Table 5, instead of the black toner 1 used in example 1. The result is shown in table 6.

At the same time, the apparent density (AD(g/cc)) of each toner was measured in the following manner.

The toner is charged into a cylindrical stainless container having a volume of 30 cc and is made to naturally fall into through a sieve until the toner stops sinking down. The apparent toner density (AD) is calculated based on the weight of the toner when the toner has settled down.

TABLE 5

| | Toner type | Silica type | Silica primary particle size(nm) | Added amount (wt %) | AD (g/cc) |
|---|---|---|---|---|---|
| Example 6 | Yellow · | A | 15 | 1 | 0.35 for all colors |
| | Magenta · Cyan | B | 40 | 1 | |
| | Black | E | 7 | 1 | 0.42 |
| | toner 5 | B | 40 | 1 | |
| Comp. Example | Yellow · | A | 15 | 1 | 0.35 for all colors |
| | Magenta · | B | 40 | 1 | |

TABLE 5-continued

| | Toner type | Silica type | Silica primary particle size(nm) | Added amount (wt %) | AD (g/cc) |
|---|---|---|---|---|---|
| 4 | Cyan | | | | |
| | Compara- | A | 15 | 1 | |
| | tive | B | 40 | 1 | |
| | black toner 1 | | | | |

TABLE 6

| Applied photoreceptor type | for yellow | for magenta | for cyan | for black |
|---|---|---|---|---|
| Example 6 | 12.3 μm | 12.3 μm | 12.2 μm | 12.2 μm |
| Comp. example 4 | 12.3 μm | 12.2 μm | 12.2 μm | 10.3 μm |

Film thickness of each photoreceptor after a 100,000 copy run (25 μm at the start)

As shown in Tables 5 and 6, when the black toner was adjusted to present a higher AD value than that of the other developing colors, all the photoreceptors after a 100,000 copy run reduced in film thickness to almost the same degree.

Example 7

Table 7 shows decay indexes (H) of the toners used in example 6 and comparative example 4. This decay index representing a value conforming to the apparent density described in example 6. That is, concerning filling the container with a toner being dropped, the toner was charged while tapping, using a power tester (manufactured by Hosokawa Micron Corporation). After enough tapping to make the density of the toner became fully saturated, the container was set upside down and tapping vibrations given again. The number of taps until the compressed toner decayed and fell is defined as the decay index (H).

The decay index indicates that the toner is likely to decay or has a higher fluidity as it is smaller. As shown in Table 7, the toner in Table 6 which caused a smaller reduction of the film thickness of the photoreceptor for black development after the running presented a lower decay index than the other toners.

TABLE 7

| Toner type | for yellow | for magenta | for cyan | for black |
|---|---|---|---|---|
| Example 6 (7) | 210 | 220 | 216 | 140 |
| Comp. example 4 | 215 | 218 | 215 | 220 |

Numeral values: decay index (H)

Examples 8 and 9

A black toner 6 was prepared on the basis of the comparative black toner 1 used in comparative example 1, by changing the added amount of the carnauba wax or adding one part of the wax by weight. The photoreceptor film thickness after a 100,000 copy run with the black toner 6 was measured similarly to example 1 (example 8). The apparent density (AD) of the black toners 6 and 7 is shown in Table 8. It should be noted that the toner compositions other than the wax are the same as that of the comparative black toner 1.

TABLE 8

| Toner | Wax: Type | Wax: DSC absorption peak temp. | Wax: Added amount | AD (g/cc) |
|---|---|---|---|---|
| Black toner 6 | Carnauba A | 82.1° C. | 1 wt. % | 0.41 |
| Black toner 7 | Polyethylene wax | 111.0° C. | 3 wt. % | 0.43 |

Note: the toner compositions other than the wax are the same as that of the comparative black toner.

A black toner 7 was prepared on the basis of the black toner 1, by adding 3 parts by weight of polyethylene wax instead of carnauba wax. The photoreceptor film thickness after a 100,000 copy run with the black toner 7 was measured similarly to example 1 (example 9). The result is shown in Table 9.

From the above result, it is possible to improve the fluidity of the toner by optimizing the amount of wax and the kind of wax, whereby it becomes possible to control the photoreceptor film thickness with the black toner of the present invention.

TABLE 9

| Applied photoreceptor type | for yellow | for magenta | for cyan | for black |
|---|---|---|---|---|
| Example 8 | 12.2 μm | 12.3 μm | 12.3 μm | 12.2 μm |
| Comp. example 9 | 12.3 μm | 12.2 μm | 12.2 μm | 12.1 μm |

Film thickness of each photoreceptor after a 100,000 copy run (25 μm at the start)

Examples 10–12•Comparative Example 5

A black toner 8 was prepared in the same manner as the comparative black toner 1 used in comparative example 1, except in that the toner particle size was adjusted to 9.5 μm and the added amount of silica A and silica B as the additives were changed to 0.8 parts by weight. A black toner 9 was prepared on the basis of the black toner used in comparative example 1, by adding a silica F instead of adding silica A of the additive compositions of the black toner. Further a black toner 10 was prepared on the basis of the black toner used in comparative example 1, by adding a reduced amount or 4.5 parts by weight of carbon black. Table 10 shows the specifications of the toners.

TABLE 10

| | Toner | Toner size | Additive: Silica 1 | Additive: Added amount | Additive: Silica 2 | Additive: Added amount | Carbon black content |
|---|---|---|---|---|---|---|---|
| Example 10 | Black toner 8 | 9.5 μm | Silica A | 0.8 wt. % | Silica B | 0.8 wt. % | 6 wt. % |
| Example 11 | Black toner 9 | 8.0 μm | Silica F | 1.0 wt. % | Silica B | 1.0 wt. % | 6 wt. % |
| Example 12 | Black toner 10 | 8.0 μm | Silica A | 1.0 wt. % | Silica B | 1.0 wt. % | 4.5 wt. % |

For each developing toner in examples 10 through 12, the amount of charge on the toner, volume resistivity and the amount of the toner adhering to the photoreceptor were measured. Further, all the photoreceptors after a copy run similar to example 1 with the corresponding black toner reduced in film thickness to almost the same degree. The result is shown in Table 11.

TABLE 11

| Item | Measured value | for yellow | for magenta | for cyan | for black |
|---|---|---|---|---|---|
| Example 10 | Photoreceptor film thickness (μm) | 12.2 | 12.3 | 12.1 | 12.0 |
| | Amount of charge (μC/g) | −25 | −26 | −25 | −28 |
| | Volume resistivity (Ω cm × $10^{11}$) | 1.02 | 1.20 | 1.14 | 1.27 |
| | Amount of adherence on the photoreceptor (mg/$cm^2$) | 6.0 | 6.2 | 5.9 | 4.8 |
| Example 11 | Photoreceptor film thickness (μm) | 12.3 | 12.2 | 12.2 | 12.2 |
| | Amount of charge (μC/g) | −26 | −26 | −27 | −35 |
| | Volume resistivity (Ω cm × $10^{11}$) | 1.04 | 1.22 | 1.12 | 1.25 |
| | Amount of adherence on the photoreceptor (mg/$cm^2$) | 6.2 | 6.1 | 6.1 | 4.6 |

TABLE 11-continued

| Item | Measured value | for yellow | for magenta | for cyan | for black |
|---|---|---|---|---|---|
| Example 12 | Photoreceptor film thickness (μm) | 12.3 | 12.3 | 12.3 | 12.1 |
| | Amount of charge (μC/g) | −26 | −26 | −25 | −29 |
| | Volume resistivity (Ω cm × $10^{11}$) | 1.10 | 1.19 | 1.17 | 2.56 |
| | Amount of adherence on the photoreceptor (mg/$cm^2$) | 6.0 | 6.2 | 6.1 | 4.9 |
| Comp. Example 5 | Photoreceptor film thickness (μm) | 12.3 | 12.2 | 12.2 | 10.3 |
| | Amount of charge (μC/g) | −26 | −26 | −26 | −25 |
| | Volume resistivity (Ω cm × $10^{11}$) | 1.11 | 1.19 | 1.15 | 1.20 |
| | Amount of adherence on the photoreceptor (mg/$cm^2$) | 6.2 | 6.0 | 6.2 | 6.3 |

From the above result, it is possible to control the film thickness of the photoreceptor, by optimizing the additives of the toner, optimizing the added wax, reducing the amount of the toner adhering to the photoreceptor or reducing stagnation of the toner on the photoreceptor surface. These film thickness control techniques may be used alone or in combination whereby it is possible to differentiate the amount of abrasion of the photoreceptor for black development from that for the other developing photoreceptors, hence make the lifetime of all the photoreceptors consistent.

(2) Examples 13 to 17 and Comparative Examples 6 to 8 for Showing Influences Depending upon the Difference of the Binder Resin for the Toner First, the black toners used for the examples and comparative examples were prepared.

Black Toner Preparation Example 1

An amount of 94 parts by weight of a non-cross-linked polyester resin (with a hardness of 85 in the durometer A scale) as a binder resin, consisting of an addition product of bisphenol A with ethylene oxide and terephthalic acid, 2 parts by weight of metal salt of alkyl salicylic acid as a charge control agent, 6 parts by weight of carbon black and 3 parts by weight of carnauba wax A as a separating agent were mixed by a Henschel mixer, then the mixture was fused and kneaded using a biaxial extrusion type kneader. The kneaded material was pulverized by a jet milling machine so that the grains were graded to prepare a black toner 11 having a mean particle size of 8 μm. This black toner 11 presented a hardness of 83 in the durometer A scale.

Further, 1 part by weight of hydrophobic silica having a primary particle size of 15 nm and 1 part by weight of hydrophobic silica having a primary particle size of 40 nm were added as toner surface treating agents, and the mixture was mixed by a Henschel mixer for additive attachement.

The obtained black toner was mixed with a ferrite carrier by a Nauta mixer, so as to provide a dual-component developer having a toner concentration of 5%.

Black Toner Preparation Example 2

An amount of 94 parts by weight of styrene-butylacrylate copolymer (with a hardness of 74 in the durometer A scale) as a binder resin, 2 parts by weight of metal salt of alkyl salicylic acid as a charge control agent, 6 parts by weight of carbon black and 3 parts by weight of carnauba wax A as a separating agent were blended by a Henschel mixer, then the mixture was fused and kneaded using a biaxial extrusion type kneader.

The kneaded material was pulverized by a jet milling machine so that the grains were graded to prepare a black toner 12 having a mean particle size of 8 μm. This black toner 12 presented a hardness of 73 in the durometer A scale.

Further, 1 part by weight of hydrophobic silica having a primary particle size of 15 nm and 1 part by weight of hydrophobic silica having a primary particle size of 40 nm were added as toner surface treating agents and then mixed by a Henschel mixer for additive attachment.

The obtained black toner was mixed with a ferrite carrier by a Nauta mixer, so as to provide a dual-component developer having a toner concentration of 5%.

Black Toner Preparation Example 3

A black toner 13 having a mean particle size of 8 μm was prepared in the same manner as in the black toner preparation example 1, except that a polyester resin having a weight average molecular weight of $5\times10^3$ was used as a binder resin. Further, 1 part by weight of hydrophobic silica having a primary particle size of 15 nm and 1 part by weight of hydrophobic silica having a primary particle size of 40 nm were added as toner surface treating agents, then mixed by a Henschel mixer for additive attachment.

The obtained black toner was mixed with a ferrite carrier by a Nauta mixer, so as to provide a dual-component developer having a toner concentration of 5%.

Black Toner Preparation Example 4

A black toner 14 having a mean particle size of 8 μm was prepared in the same manner as in the black toner preparation example 1, except that a polyester resin having a weight average molecular weight of $2\times10^4$ was used as a binder resin. By a GPC analysis of the molecular weight distribution of the THF-solubles of this polyester resin, the molecular weight peak on the highest side was found at $1\times10^5$.

Further, 1 part by weight of hydrophobic silica having a primary particle size of 15 nm and 1 part by weight of hydrophobic silica having a primary particle size of 40 nm were added as toner surface treating agents, then mixed by a Henschel mixer for additive attachment.

The obtained black toner was mixed with a ferrite carrier by a Nauta mixer, so as to provide a dual-component developer having a toner concentration of 5%.

Black Toner Preparation Example 5

A black toner 15 having a mean particle size of 8 μm was prepared in the same manner as in the black toner preparation example 1, except that a polyester resin (containing 1 wt. % THF-insolubles) consisting of an addition product of bisphenol A with ethylene oxide and terephthalic acid was used as a binder resin.

Further, 1 part by weight of hydrophobic silica having a primary particle size of 15 nm and 1 part by weight of hydrophobic silica having a primary particle size of 40 nm were added as toner surface treating agents, then mixed by a Henschel mixer for additive attachment. The obtained black toner was mixed with a ferrite carrier by a Nauta mixer, so as to provide a dual-component developer having a toner concentration of 5%.

Comparative Black Toner Preparation Example 1

A comparative black toner 11 having a mean particle size of 8 μm was prepared in the same manner as in the black toner preparation example 1, except that a cross-linked polyester resin (with a hardness of 92 in the durometer A scale) consisting of an addition product of bisphenol A with ethylene oxide and terephthalic acid was used as a binder resin. This comparative black toner 11 presented a hardness of 92 in the durometer A scale. Further, 1 part by weight of hydrophobic silica having a primary particle size of 15 nm and 1 part by weight of hydrophobic silica having a primary particle size of 40 nm were added as toner surface treating agents, and then mixed by a Henschel mixer for additive attachment.

The obtained black toner was mixed with a ferrite carrier by a Nauta mixer, so as to provide a dual-component developer having a toner concentration of 5%.

Comparative Black Toner Preparation Example 2

A comparative black toner 12 having a mean particle size of 8 μm was prepared in the same manner as in the preparation example 1 of black toner 11, except that a polyester resin having a weight average molecular weight of $2\times10^4$ was used as a binder resin. By a GPC analysis of the molecular weight distribution of the THF-solubles of this polyester resin, the molecular weight peak on the highest side was found at $2\times10^5$.

Further, 1 part by weight of hydrophobic silica having a primary particle size of 15 nm and 1 part by weight of hydrophobic silica having a primary particle size of 40 nm were added as toner surface treating agents, then mixed by a Henschel mixer for additive attachment.

The obtained black toner was mixed with a ferrite carrier by a Nauta mixer, so as to provide a dual-component developer having a toner concentration of 5%.

Comparative Black Toner Preparation Example 3

A comparative black toner 13 having a mean particle size of 8 μm was prepared in the same manner as in the black toner preparation example 1, except that a polyester resin (containing 25 wt. % THF-insolubles) consisting of an addition product of bisphenol A with ethylene oxide, tetra-propenyl succinic anhydride and terephthalic acid was used as a binder resin.

Further, 1 part by weight of hydrophobic silica having a primary particle size of 15 nm and 1 part by weight of hydrophobic silica having a primary particle size of 40 nm were added as toner surface treating agents, then mixed by a Henschel mixer for additive attachment.

The obtained black toner was mixed with a ferrite carrier by a Nauta mixer, so as to provide a dual-component developer having a toner concentration of 5%.

Next, color toners (the other developing toners) used for the examples and comparative examples were prepared as follows.

Color Toner Preparation Example 1

An amount of 94 parts by weight of a cross-linked polyester resin (with a hardness of 92 in the durometer A scale) as a binder resin, consisting of an addition product of bisphenol A with ethylene oxide, terephthalic acid and trimellitic acid, 2 parts by weight of metal salt of alkyl salicylic acid as a charge control agent, 4 parts by weight of a coloring agent selected from the following cyan, magenta and yellow coloring agents, 4 parts by weight of carnauba wax A as a separating agent were mixed by a Henschel mixer, then the mixture was fused and kneaded using a biaxial extrusion type kneader. The kneaded material was pulverized by a jet milling machine so that the grains were graded to prepare a color toner 11 for each color, having a mean particle size of 8 μm.

<Coloring Agents>

Cyan (C): C. I. Pig. B-15

Magenta (M): C. I. Pig. R-122

Yellow (Y); C. I. Pig. Y-17

The hardnesses in the durometer A scale of these color toners were, 90 for cyan toner 11, 91 for magenta toner 11 and 89 for yellow toner 11, respectively.

Further, 1 part by weight of hydrophobic silica having a primary particle size of 15 nm and 1 part by weight of hydrophobic silica having a primary particle size of 40 nm were added as toner surface treating agents, then mixed by a Henschel mixer for additive attachment.

For each color, the obtained toner was mixed with a ferrite carrier by a Nauta mixer, so as to provide a dual-component developer having a toner concentration of 5%.

Color Toner Preparation Example 2

Three color toners 12 were prepared as follows. Each color toner 12 having a mean particle size of 8 μm was prepared in the same manner as in the color toner preparation example 1, except that a polyester resin having a weight average molecular weight of $2\times10^4$ was used as a binder resin. By a GPC analysis of the molecular weight distribution of the THF-solubles of this polyester resin, the molecular weight peak on the highest side was found at $2\times10^5$.

Further, 1 part by weight of hydrophobic silica having a primary particle size of 15 nm and 1 part by weight of hydrophobic silica having a primary particle size of 40 nm were added as toner surface treating agents, then mixed by a Henschel mixer for additive attachment.

Each color toner thus obtained was mixed with a ferrite carrier by a Nauta mixer, so as to provide a dual-component developer having a toner concentration of 5%.

Color Toner Preparation Example 3

Three color toners 13 were prepared as follows. Each color toner 13 having a mean particle size of 8 μm was prepared in the same manner as in the color toner preparation example 1, except that a polyester resin (containing 25 wt. % THF-insolubles) consisting of an addition product of bisphenol A with ethylene oxide, tetra-propenyl succinic anhydride and terephthalic acid was used as a binder resin.

Further, 1 part by weight of hydrophobic silica having a primary particle size of 15 nm and 1 part by weight of hydrophobic silica having a primary particle size of 40 nm were added as toner surface treating agents, then mixed by a Henschel mixer for additive attachment.

Each color toner thus obtained was mixed with a ferrite carrier by a Nauta mixer, so as to provide a dual-component developer having a toner concentration of 5%.

Examples 13•Comparative Example 6

With the black toner 11 prepared in the black toner preparation example land the Y, M and C color toners 11 prepared in the color toner preparation example 1, a running test of 100,000 copies in the usual usage mode was carried out in a full-color copier AR-C150 (a product of Sharp Corporation) illustrated in FIG. 1. Concerning the abrasion performance (the abrasion loss) of the photoreceptors after the running test, the photoreceptor for black development had a greater abrasion loss than those with the color toners 11 did, as shown in Table 12, but presented a lower abrasion loss than that with the comparative black toner 11 prepared in comparative preparation example 1. The usual usage mode mentioned here was set so that the ratio between the full-color mode usage and the monochrome mode usage became 3:2. The film thickness of each photoreceptor at the start was 25 μm.

Example 14•Comparative Example 6

A 100,000 copy run with the black toner 12 prepared in the black toner preparation example 2 and the Y, M and C color toners 11 prepared in the color toner preparation example 1 was carried out in the image forming apparatus. Concerning the abrasion performance of the photoreceptors, the running test caused approximately uniform reduction in film thickness for all the photoreceptors, as seen in Table 12. On the other hand, when the comparative black toner 11 prepared in comparative preparation example 1 was used, only the photoreceptor for black development reduced in film thickness to a greater degree.

Example 15•Comparative Example 7

A 100,000 copy run with the black toner 13 prepared in the black toner preparation example 3 and the Y, M and C color toners 12 prepared in the color toner preparation example 2 was carried out in the image forming apparatus. Concerning the abrasion performance of the photoreceptors, the running test caused approximately uniform reduction in film thickness for all the photoreceptors, as seen in Table 12. On the other hand, when the comparative black toner 12 prepared in comparative preparation example 2 was used, only the photoreceptor for black development reduced in film thickness to a greater degree.

Example 16•Comparative Example 7

A 100,000 copy run with the black toner 14 prepared in the black toner preparation example 4 and the Y, M and C color toners 12 prepared in the color toner preparation example 2 was carried out in the image forming apparatus. Concerning the abrasion performance of the photoreceptors, the running test caused approximately uniform reduction in film thickness for all the photoreceptors, as seen in Table 12. On the other hand, when the comparative black toner 12 prepared in comparative preparation example 2 was used, only the photoreceptor for black development reduced in film thickness to a greater degree.

Example 17•Comparative Example 8

A 100,000 copy run with the black toner 15 prepared in the black toner preparation example 5 and the Y, M and C color toners 13 prepared in the color toner preparation example 3 was carried out in the image forming apparatus. Concerning the abrasion performance of the photoreceptors, the running test caused approximately uniform reduction in film thickness for all the photoreceptors, as seen in Table 12. On the other hand, when the comparative black toner 13 prepared in comparative preparation example 3 was used, only the photoreceptor for black development reduced in film thickness to a greater degree.

TABLE 12

| Item | Item | for yellow | for magenta | for cyan | for black |
|---|---|---|---|---|---|
| Example 13 | Toner | Yellow toner 11 | Magenta toner 11 | Cyan toner 11 | Black toner 11 |
| | Photoreceptor film thickness | 12.2 μm | 12.3 μm | 12.2 μm | 11.4 μm |

TABLE 12-continued

| Item | Item | for yellow | for magenta | for cyan | for black |
|---|---|---|---|---|---|
| Example 14 | Toner | Yellow toner 11 | Magenta toner 11 | Cyan toner 11 | Black toner 12 |
| | Photoreceptor film thickness | 12.1 μm | 12.3 μm | 12.2 μm | 12.2 μm |
| Example 15 | Toner | Yellow toner 12 | Magenta toner 12 | Cyan toner 12 | Black toner 13 |
| | Photoreceptor film thickness | 11.8 μm | 11.7 μm | 11.7 μm | 11.9 μm |
| Example 16 | Toner | Yellow toner 12 | Magenta toner 12 | Cyan toner 12 | Black toner 14 |
| | Photoreceptor film thickness | 11.8 μm | 11.7 μm | 11.8 μm | 11.5 μm |
| Example 17 | Toner | Yellow toner 13 | Magenta toner 13 | Cyan toner 13 | Black toner 15 |
| | Photoreceptor film thickness | 13.1 μm | 13.0 μm | 13.1 μm | 13.2 μm |
| Comp. Example 6 | Toner | Yellow toner 11 | Magenta toner 11 | Cyan toner 11 | Comp. black toner 11 |
| | Photoreceptor film thickness | 12.3 μm | 12.2 μm | 12.2 μm | 10.3 μm |
| Comp. Example 7 | Toner | Yellow toner 12 | Magenta toner 12 | Cyan toner 12 | Comp. black toner 12 |
| | Photoreceptor film thickness | 11.7 μm | 11.8 μm | 11.7 μm | 9.5 μm |
| Comp. Example 8 | Toner | Yellow toner 13 | Magenta toner 13 | Cyan toner 13 | Comp. black toner 13 |
| | Photoreceptor film thickness | 13.3 μm | 13.1 μm | 13.2 μm | 10.7 μm |

Film thickness of each photoreceptor after a 100,000 copy run (25 μm at the start)

As shown in Table 12, the black toner is adapted so that it presents a lower abrading effect than the other developing toners, whereby it is possible to extend the life of the photoreceptor for black development. Thus, it was found that the abrading force of the toner against the photoreceptor surface can be controlled by the hardness of the toner, hence by adjusting the hardness of the binder resin for the toner.

(3) Examples 18 to 23 and Comparative Examples 9 to 14 for Presenting the Behaviors During Development (During the Stabilized Processing State) Depending on the Difference in Toner Concentration and the Carrier Difference Preparation Example of a Black Toner and a Carrier for the Toner An amount of 94 parts by weight of a polyester resin as a binder resin, 2 parts by weight of metal salt of alkyl salicylic acid as a charge control agent, 6 parts by weight of carbon black and 3 parts by weight of carnauba wax A as a separating agent were mixed by a Henschel mixer, then the mixture was fused and kneaded using a biaxial extrusion type kneader. The kneaded material was pulverized by a jet milling machine so that the grains were graded to prepare a black toner having a mean particle size of 8 μm.

Further, 1 part by weight of hydrophobic silica having a primary particle size of 15 nm and 1 part by weight of hydrophobic silica having a primary particle size of 40 nm were added as toner surface treating agents, and then mixed by a Henschel mixer for additive attachment. The obtained black toner was mixed with a ferrite powder carrier by a Nauta mixer, so as to provide a dual-component black developer.

Preparation Example of the Other Developing Toners and a Carrier for the Toners

An amount of 94 parts by weight of a polyester resin as a binder resin, 2 parts by weight of metal salt of alkyl salicylic acid as a charge control agent, 4 parts by weight of a coloring agent selected from the following cyan, magenta and yellow coloring agents, 3 parts by weight of carnauba wax A as a separating agent were mixed by a Henschel mixer, then the mixture was fused and kneaded using a biaxial extrusion type kneader. The kneaded material was pulverized by a jet milling machine so that the grains were graded to prepare a developing toner having a mean particle size of 8 μm for each color.

<Coloring Agents>

Cyan (C): C. I. Pig. B-15

Magenta (M): C. I. Pig. R-122

Yellow (Y); C. I. Pig. Y-17

Further, 1 part by weight of hydrophobic silica having a primary particle size of 15 nm and 1 part by weight of hydrophobic silica having a primary particle size of 40 nm were added as toner surface treating agents, then mixed by a Henschel mixer for additive attachment. For each color, the obtained color developing toner was mixed with a ferrite powder carrier by a Nauta mixer, so as to provide a dual-component color developer.

The physical properties of the carriers used in the examples and comparative examples are shown in Table 13 below.

TABLE 13

| | Item | Toner Conc. (%) | Particle size (μm) | Sturation magnetization (emu/g) | Shape | Specific surface area ($m^2/g$) | Current (μA) |
|---|---|---|---|---|---|---|---|
| No. 1 | Carrier for the black toner of example 18 | 5.0 | 73 | 105 | irregular | 295 | 165 |
| | For the color toners of example 18 and for all the toners of comp. example 9 | 6.5 | 73 | 105 | irregular | 295 | 165 |
| No. 2 | Carrier for the black toner of example 19 | 6.5 | 62 | 108 | irregular | 309 | 174 |
| | For the color toners of example 19 and for all the toners of comp. example 10 | 6.5 | 73 | 105 | irregular | 295 | 165 |
| No. 3 | Carrier for the black toner of example 20 | 6.5 | 68 | 85 | irregular | 296 | 168 |
| | For the color toners of example 18 and for all the toners of comp. example 11 | 6.5 | 70 | 103 | irregular | 303 | 175 |
| No. 4 | Carrier for the black toner of example 21 | 6.5 | 68 | 101 | spherical | 289 | 172 |
| | For the color toners of example 21 and for all the toners of comp. example 12 | 6.5 | 71 | 104 | irregular | 302 | 170 |
| No. 5 | Carrier for the black toner of example 22 | 6.5 | 71 | 108 | irregular | 220 | 169 |
| | For the color toners of example 22 and for all the toners of comp. example 13 | 6.5 | 71 | 105 | irregular | 307 | 168 |
| No. 6 | Carrier for the black toner of example 23 | 6.5 | 70 | 101 | spherical | 301 | 112 |
| | For the color toners of example 23 and for all the toners of comp. example 14 | 6.5 | 73 | 105 | irregular | 298 | 170 |

(Testing Method)

After a running test of 100,000 copies in the usual usage mode was carried out in a full-color copier AR-C150 (a product of Sharp Corporation) illustrated in FIG. 1, with the dual-component black developer and dual-component color developers thus prepared, the film thickness of each photoreceptor after being worn down was measured. The usual usage mode mentioned here was set so that the ratio between the full-color mode usage and the monochrome mode usage became 3:2. The film thickness of each photoreceptor at the start was 25 μm.

Example 18 and Comparative Example 9

When the image forming apparatus was operated with the black developer adjusted so as to contain a 5.0% black toner and the developers for the other colors each adjusted so as to contain a 6.5% color toner, after printing of 100,000 copies the film thickness of the photoreceptor for black development reduced to an equivalent level to that of the photoreceptors for the other colors, as shown in FIG. 14.

In contrast, when both the black developer and the developers for the other colors were adjusted so as to have a toner concentration of 6.5%, the coating film on the photoreceptor for black development became thinner than that of the other developing photoreceptors, as shown in FIG. 14.

Example 19 and Comparative Example 10

When the image forming apparatus was operated with a black developer prepared with a ferrite powder carrier having a particle size of 62 μm and the other color developers each prepared with a ferrite powder carrier having a particle size of 73 μm, after printing of 100,000 copies the film thickness of the photoreceptor for black development reduced to an equivalent level to that of the photoreceptors for the other colors, as shown in FIG. 14.

In contrast, when both the black developer and the developers for the other colors were prepared with an iron powder carrier having a particle size of 73 μm, the film on the photoreceptor for black development became thinner than that of the other developing photoreceptors, as shown in FIG. 14.

Example 20 and Comparative Example 11

When the image forming apparatus was operated with a dual-component black developer prepared with a ferrite powder carrier having a saturation magnetization of 85 emu/g and the other dual-component developers each prepared with an iron powder carrier having a saturation magnetization of 103 emu/g, after printing of 100,000 copies the film thickness of the photoreceptor for black development reduced to an equivalent level to that of the photoreceptors for the other developing colors, as shown in FIG. 14.

In contrast, when both the dual-component black developer and the developers for the other colors were prepared with an iron powder carrier having a saturation magnetization of 103 emu/g, the film on the photoreceptor for black development became thinner than that of the other developing photoreceptors, as shown in FIG. 14.

Example 21 and Comparative Example 12

When the image forming apparatus was operated with a dual-component black developer prepared with a ferrite powder carrier having almost spherical shapes and the other developers each prepared with an iron powder carrier having irregular shapes, after printing of 100,000 copies the film thickness of the photoreceptor for black development reduced to an equivalent level to that of the photoreceptors for the other developing colors, as shown in FIG. 14.

In contrast, when both the dual-component black developer and the developers for the other colors were prepared with an iron powder carrier having irregular shapes, the film on the photoreceptor for black development became thinner than that of the other color developing photoreceptors, as shown in FIG. 14. The carrier shape was determined by observing the images taken by an electron microscope.

Example 22 and Comparative Example 13

When the image forming apparatus was operated with a dual-component black developer prepared with a ferrite powder carrier having a specific surface area of 220 $m^2/g$ and the other developers each prepared with a ferrite powder carrier having a specific surface area of 307 $m^2/g$, after printing of 100,000 copies the film thickness of the photoreceptor for black development reduced to an equivalent level to that of the photoreceptors for the other developing colors, as shown in FIG. 14.

In contrast, when both the dual-component black developer and the developers for the other colors were prepared with a ferrite powder carrier having a specific surface area of 307 $m^2/g$, the film on the photoreceptor for black development became thinner than that of the other color developing photoreceptors, as shown in FIG. 14.

The weight average particle sizes of the carriers in all the developers were almost equal, within the range of ±0.5 μm.

Example 23 and Comparative Example 14

When the image forming apparatus was operated with a dual-component black developer prepared with a ferrite powder carrier presenting an electric current value of 112 μA and the other developers each prepared with a ferrite powder carrier presenting an electric current value of 170 μA, after printing of 100,000 copies the film thickness of the photoreceptor for black development reduced to an equivalent level to that of the developing photoreceptors, as shown in FIG. 14.

In contrast, when both the black developer and the developers for the other colors were prepared with a ferrite powder carrier presenting an electric current value of 170 μA, the coating film on the photoreceptor for black development became thinner than that of the other developing photoreceptors, as shown in FIG. 14.

TABLE 14

| Applied photoreceptor type | for yellow | for magenta | for cyan | for black |
|---|---|---|---|---|
| Example 18 | 12.3 μm | 12.2 μm | 12.2 μm | 12.0 μm |
| Comp. example 9 | 12.3 μm | 12.1 μm | 12.2 μm | 10.3 μm |
| Example 19 | 12.3 μm | 12.3 μm | 12.1 μm | 11.9 μm |
| Comp. example 10 | 12.2 μm | 12.2 μm | 12.1 μm | 10.2 μm |
| Example 20 | 12.3 μm | 12.3 μm | 12.1 μm | 11.9 μm |
| Comp. example 11 | 12.1 μm | 12.2 μm | 12.3 μm | 10.5 μm |
| Example 21 | 12.2 μm | 12.1 μm | 12.2 μm | 12.1 μm |
| Comp. example 12 | 12.3 μm | 12.2 μm | 12.0 μm | 10.1 μm |
| Example 22 | 12.3 μm | 12.3 μm | 12.1 μm | 11.9 μm |
| Comp. example 13 | 12.3 μm | 12.1 μm | 12.2 μm | 10.1 μm |
| Example 23 | 12.2 μm | 12.1 μm | 12.2 μm | 11.9 μm |
| Comp. example 14 | 12.3 μm | 12.2 μm | 12.2 μm | 10.0 μm |

Film thickness of each photoreceptor after a 100,000 copy run (25 μm at the start)

There is a concern that the image density may lower due to decrese of the amount of toner adherence onto the photoreceptor entailed with increase in charge on the toner. To eradiacate this concern, image density, background fog, the amount of charge and the amount of adherence at the intial stage and after printing of 100,000 copies were measured for each physical property of the carrier, and the measured values were given as the average. As shown in Table 15, though a slight tendency toward reduction in image density accompanying the increase in toner charge amount was observed, both the image density and background fog fell within permissible ranges for practical use.

Here, the measurement of image density was carried out with a MACBETH reflection densitometer RD918. The measurement of background fog was carried out using a Hunter whiteness meter manufactured by NIPPON DENSHOKU INDUSTRIES CO., LTD. The toner charge amount was measured by the blowoff method using the developer which was blended with the carrier so as to have a toner concentration of 6.5%.

TABLE 15

| | Developer type | Image density | Fog | Toner charge amount (μC/g) | Amount of adherence ($mg/cm^2$) |
|---|---|---|---|---|---|
| Example 18 | Average value for the colors | 1.52 | 1.03 | −20.6 | 0.98 |
| | for black | 1.45 | 0.86 | −31.8 | 0.62 |

TABLE 15-continued

| | Developer type | Image density | Fog | Toner charge amount (μC/g) | Amount of adherence (mg/cm²) |
|---|---|---|---|---|---|
| Comp. example 9 | Average value for the colors | 1.51 | 0.95 | −21.3 | 0.95 |
| | for black | 1.50 | 0.98 | −22.3 | 0.99 |
| Example 19 | Average value for the colors | 1.48 | 0.92 | −23.0 | 0.89 |
| | for black | 1.46 | 0.78 | −31.2 | 0.68 |
| Comp. example 10 | Average value for the colors | 1.52 | 0.99 | −22.8 | 0.99 |
| | for black | 1.51 | 0.90 | −24.0 | 0.89 |
| Example 20 | Average value for the colors | 1.50 | 0.90 | −21.7 | 0.97 |
| | for black | 1.48 | 0.91 | −21.0 | 0.99 |
| Comp. example 11 | Average value for the colors | 1.53 | 0.89 | −22.3 | 0.89 |
| | for black | 1.54 | 0.93 | −21.8 | 0.95 |
| Example 21 | Average value for the colors | 1.49 | 1.02 | −23.2 | 1.00 |
| | for black | 1.50 | 0.96 | −22.0 | 0.93 |
| Comp. example 12 | Average value for the colors | 1.48 | 0.95 | −23.2 | 0.92 |
| | for black | 1.51 | 0.91 | −23.8 | 0.91 |
| Example 22 | Average value for the colors | 1.50 | 1.01 | −21.2 | 1.04 |
| | for black | 1.50 | 0.99 | −22.0 | 0.99 |
| Comp. example 13 | Average value for the colors | 1.48 | 0.90 | −22.2 | 0.87 |
| | for black | 1.50 | 0.95 | −21.8 | 0.94 |
| Example 23 | Average value for the colors | 1.47 | 0.94 | −23.9 | 0.91 |
| | for black | 1.43 | 0.81 | −30.8 | 0.73 |
| Comp. example 14 | Average value for the colors | 1.49 | 1.03 | −21.4 | 1.06 |
| | for black | 1.48 | 1.00 | −22.1 | 1.01 |

From the above result, it is possible to control the coating film thickness of the photoreceptor, by using a developer with its carrier property optimized, whereby it is possible to differentiate the amount of abrasion of the photoreceptor for black development from that for the other developing photoreceptors, hence make the lifetime of all the photoreceptors consistent.

According to the image forming apparatus of the present invention, since the plural toners at least include a black toner, and the abrading force of the black toner or the carrier therein acting on the photoreceptor surface is adjusted so as to be smaller than that of the other developing toners or their carrier therein. Accordingly, the speeds at which the drums are worn away can be made equal, so that it is possible to prevent only one drum from being degraded too far. As a result the problem of failing to obtain good image quality due to a color imbalance between the drums, which would occur between a new drum and the other used drums when only a single drum was replaced instead of replacing all the drums as used to be done in the conventional configuration. That is, the intervals for replacement of all the four drums are made equal, thus making it possible to avoid wasteful replacement. Therefore, it is possible to provide a multicolor image forming apparatus which is remarkably useful.

What is claimed is:

1. An image forming apparatus having a tandem system configuration, including: a multiple number of photoreceptors which each form an electrostatic latent image; and a multiple number of developing devices each holding a different color toner from the others for development of the corresponding static latent image, characterized in that the plural toners at least include a black toner, and the abrading force of the black toner against the photoreceptor surface is adjusted so as to be smaller than the abrading force of the other developing toners.

2. The image forming apparatus according to claim 1, wherein the multiple toners are configured so that each toner is externally added with a surface treating agent on the surf ace thereof and the abrading force of the black toner will be smaller than the abrading force of the other developing toners.

3. The image forming apparatus according to claim 2, wherein the amount of the surface treating agent added to each of the other developing toners is specified to be greater than the amount of the surface treating agent added to the black toner.

4. The image forming apparatus according to claim 2, wherein the surface treating agent consists of at least one or more kinds of additives, and the secondary particle size of the additive which is added in the black toner and presents the largest secondary particle size is smaller than the secondary particle size of the additive which is added in each of the other developing toners and presents the largest secondary particle size.

5. The image forming apparatus according to claim 4, wherein the primary particle of the additive which is added in the black toner and presents the largest secondary particle size has a more rounded shape than the primary particle of the additive which is added in each of the other developing toners and presents the largest secondary particle size.

6. The image forming apparatus according to claim 2, where A<B holds where A represents the remaining ratio of the surface treating agent added in the black toner and B represents the remaining ratio of the surface treating agent added in the other developing toners.

7. The image forming apparatus according to claim 2, wherein de surface treating agent added in the black toner consists of silica only while the surface creating agent added in the other developing toners consists of at least one of silica titanium oxide, alumina and white organic fine particles.

8. The image forming apparatus according to claim 1, wherein the fluidity of the black toner is higher then the fluidity of the other developing toners.

9. The image forming apparatus according to claim 8, wherein the apparent density (AD) of the black toner is greater than the apparent density (AD) of the other developing toners.

10. The image forming apparatus according to claim 8, wherein the decay index (HB) of the black toner is smaller than the decay index (HC) of the other developing toners, where the decay index (H) is defined as the number of applications of tapping vibration to the compacted toner which was compressed while tapping, until the compressed toner decays.

11. The image forming apparatus according to claim 8, wherein the total added amount of wax in the black toner is lower than the total added amount of wax in each of the other developing toners.

12. The image forming apparatus according to claim 11, wherein the lowest peak temperature among the DSC peak temperatures of the wax in the black toner is higher then the lowest peak temperature among the DSC peak temperatures of the wax in the other developing toners.

13. The image forming apparatus according to claim 1, wherein, with the toners, the amount of the black toner adhering to the photoreceptor is lower than the amount of each of the other developing toners to the corresponding photoreceptor.

14. The image forming apparatus according to claim 13, wherein the amount of charge on the black toner is higher than the amount of charge on the other developing toners.

15. The imaging forming apparatus according to claim 13, wherein the volume resistivity of the black toner is higher than the volume resistivity of the other developing toners.

16. The image forming apparatus according to claim 1, wherein the binder resin contained in the black toner and the binder resin containers in the other developing toners are different in physical properties or type.

17. The image forming apparatus according to claim 16, wherein the durometer hardness of the black toner at normal temperature is lower than the durometer hardnesses of the other developing toners at normal temperature.

18. The image forming apparatus according to claim 17, wherein the durometer hardness of the binder resin contained in the black toner, at normal temperature is lower than the durometer hardness of the binder resin contained in the other developing toners, at normal temperature.

19. The image forming apparatus according to claim 18, wherein the durometer hardness of the binder resin contained in the black toner, at normal temperature is smaller by 10 or more in the durometer scale than the durometer hardness of the binder resin contained in the other developing toners, at normal temperature.

20. The image forming apparatus according to claim 16, wherein the binder resin contained in the black toner is the seine kind as the binder resin contained in the other developing toners, and the binder resin contained in the black toner has a smaller weight average molecular weight than the binder resin contained in the other developing toners.

21. The image forming apparatus according to claim 16, wherein the binder resin contained in the black toner is the same kind as the binder resin contained in the other developing toners, and the peak or shoulder of the binder resin contained in the black toner, which is located on the highest molecular weight side in the molecular weight distribution of the THF (tetrehydrofuran) solubles of the binder resin by GPC(gel permeation chromatography), exists at a position to the lower molecular weight side than the peak or shoulder of the binder resin contained in the other developing tenors, which is located on the highest molecular weight side.

22. The image forming apparatus according to claim 16, wherein the binder resin contained in the black toner is the same kind as the binder resin contained in the other developing toners, and the THF insolubles of the binder resin contained in the black toner is smaller in quantity than the THF insolubles of the binder resin contained in the other developing toners.

23. The image forming apparatus according to claim 16, wherein the binder resin contained in the black toner is a non-cross-linked type resin while the binder resin contained in the other developing toners is a cross-linked type resin.

24. The image forming apparatus according to claim 1, wherein each of the plural toners is used with a carrier to as to constitute a dual-component developer.

25. The image forming apparatus according to claim 24, wherein the concentration of each of the multiple tenors upon development falls within the range of 3 to 6%.

26. The image forming apparatus according to claim 1, wherein each of the plural toners is used with a carrier so as to constitute a dual-component developer, and the black toner concentration upon development is lower than the concentration of the other developing toners.

27. The image forming apparatus according to claim 26, wherein the concentration of the black toner is lower by 0.5 to 2.0% than the concentration of the other developing toners.

28. A developer used in the image forming apparatus according to claim 1.

29. An image forming apparatus having a tandem system configuration, including: a multiple number of photoreceptors which each form an electrostatic latent image; and a multiple number of developing devices each holding a different color toner from the others for development of the corresponding static latent image, characterized in that the plural toners at least include a black toner, and the abrading force of the carrier used with the black toner against the photoreceptor surface is adjusted so as to be smaller than the abrading force of the carrier used with the other developing toners against the photoreceptor surface.

30. The image forming apparatus according to claim 29, wherein the particle size of the carrier used with the black toner is smaller than the particle size of the carrier used with the other developing toners.

31. The image forming apparatus according to claim 30, wherein the mean particle size of the carrier used with the black toner is smaller by the range of 5 to 15 $\mu$m than the mean particle size of the carrier used with the other developing toners.

32. The image forming apparatus according to claim 29, wherein the particle size of the carrier used with each of the multiple toners falls within the range of 60 to 110 $\mu$m.

33. The image forming apparatus according to claim 29, wherein the saturation magnetization of the carrier used with the black toner is lower than the carrier used with the other developing toners.

34. The image forming apparatus according to claim 33, wherein the saturation magnetization of the carrier used with the black toner is lower by the range of 5 to 20 emu/g than the carrier used with the other developing tenors.

35. The image forming apparatus according to claim 29, wherein the shape of the carrier used with the black toner is higher in sphere city than the shape of the carrier used with the other developing toners.

36. The image forming apparatus according to claim 29, wherein the carriers used with the multiple toners all have the same or almost the same means particle size falling within a permissible range of ±0.5 $\mu$m, and the specific surface area of the carrier used with the black toner is smaller than the specific surface area of the carrier used in the other developing toners.

37. The image forming apparatus according to claim 29, wherein the current value of the carrier used with the black toner is lower than the current value of the carrier used with the other developing toners.

38. The image forming apparatus according to claim 37, wherein the current value of the carrier used with the black toner is lower by the range of 50 to 100 $\mu$A than the current value of the carrier used with the other developing toners.

39. The image forming apparatus according to claim 29, wherein the carriers is composed of resin-coated cores, one or mote kinds of cores, selected from iron powder, ferrite and magnetite, and the carrier used with the black inner has a different type of core from that of the carrier used with the other developing toner.

* * * * *